US008378523B2

(12) United States Patent
Cook et al.

(10) Patent No.: US 8,378,523 B2
(45) Date of Patent: Feb. 19, 2013

(54) TRANSMITTERS AND RECEIVERS FOR WIRELESS ENERGY TRANSFER

(75) Inventors: Nigel Cook, El Cajon, CA (US); Hanspeter Widmer, Wohlenschwill (CH); Lukas Sieber, Fribourg (CH); Stephen Dominiak, Bern (CH)

(73) Assignee: Qualcomm Incorporated, San Diego, CA (US)

( * ) Notice: Subject to any disclaimer, the term of this patent is extended or adjusted under 35 U.S.C. 154(b) by 430 days.

(21) Appl. No.: 12/211,706

(22) Filed: Sep. 16, 2008

(65) Prior Publication Data

US 2011/0266878 A9 Nov. 3, 2011

Related U.S. Application Data

(63) Continuation-in-part of application No. 12/018,069, filed on Jan. 22, 2008.

(60) Provisional application No. 60/973,100, filed on Sep. 17, 2007, provisional application No. 60/904,628, filed on Mar. 2, 2007.

(51) Int. Cl.
*H01F 27/00* (2006.01)
*H01F 38/00* (2006.01)

(52) U.S. Cl. ..... 307/104; 361/143; 361/159

(58) Field of Classification Search ..... 307/104; 361/143, 159

See application file for complete search history.

(56) References Cited

U.S. PATENT DOCUMENTS 3,098,971 A 7/1963 Richardson
3,480,229 A * 11/1969 Entremont ..... 242/118.4
3,588,905 A 6/1971 Dunlavy, Jr.
3,675,108 A 7/1972 Nicholl
3,918,062 A 11/1975 Haruki et al.
3,938,018 A 2/1976 Dahl
3,999,185 A 12/1976 Polgar, Jr. et al.
4,088,999 A 5/1978 Fletcher et al.
4,388,524 A 6/1983 Walton
4,390,924 A 6/1983 Nebiker, Jr.
4,473,825 A 9/1984 Walton
4,524,411 A 6/1985 Willis
4,914,539 A 4/1990 Turner et al.
4,959,568 A 9/1990 Stokes
4,959,764 A 9/1990 Bassett
5,027,709 A 7/1991 Slagle
5,072,233 A 12/1991 Zanzig
5,153,583 A 10/1992 Murdoch
5,175,561 A 12/1992 Goto
5,387,818 A 2/1995 Leibowitz
5,396,538 A 3/1995 Hong
5,397,962 A 3/1995 Moslehi
5,438,699 A 8/1995 Coveley
5,450,305 A 9/1995 Boys et al.

(Continued)

FOREIGN PATENT DOCUMENTS

CN 1202025 A 12/1998
CN 1231069 A 10/1999

(Continued)

OTHER PUBLICATIONS

"Wireless Non-Radiative Energy Transfer", MIT paper, publication and date unknown, believed to be 2007.

(Continued)

*Primary Examiner* — Hal Kaplan
(74) *Attorney, Agent, or Firm* — Knobbe Martens Olson & Bear, LLP

(57) ABSTRACT

Techniques for wireless power transmission. An antenna has a part that amplifies a flux to make the antenna have a larger effective size than its actual size.

70 Claims, 17 Drawing Sheets

U.S. PATENT DOCUMENTS

| | | | | |
|---|---|---|---|---|
| 5,455,466 | A | 10/1995 | Parks et al. | |
| 5,491,715 | A | 2/1996 | Flaxl | |
| 5,519,262 | A | 5/1996 | Wood | |
| 5,596,567 | A | 1/1997 | DeMuro et al. | |
| 5,608,417 | A | 3/1997 | De Vall | |
| 5,621,322 | A | 4/1997 | Ehnholm | |
| 5,654,621 | A | 8/1997 | Seelig | |
| 5,684,828 | A | 11/1997 | Bolan et al. | |
| 5,734,255 | A | 3/1998 | Thompson et al. | |
| 5,767,601 | A | 6/1998 | Uchiyama | |
| 5,796,240 | A | 8/1998 | Saito et al. | |
| 5,821,638 | A | 10/1998 | Boys et al. | |
| 5,856,710 | A | 1/1999 | Baughman et al. | |
| 5,936,575 | A | 8/1999 | Azzarelli et al. | |
| 5,963,012 | A | 10/1999 | Garcia et al. | |
| 5,966,941 | A * | 10/1999 | Ghoshal | 62/3.7 |
| 5,975,714 | A | 11/1999 | Vetorino et al. | |
| 5,982,139 | A | 11/1999 | Parise | |
| 6,016,046 | A | 1/2000 | Kaite et al. | |
| 6,028,413 | A | 2/2000 | Brockmann | |
| 6,031,708 | A | 2/2000 | Guermeur | |
| 6,040,680 | A | 3/2000 | Toya et al. | |
| 6,040,986 | A | 3/2000 | Sakamoto et al. | |
| 6,104,354 | A | 8/2000 | Hill et al. | |
| 6,114,834 | A | 9/2000 | Parise | |
| 6,127,799 | A | 10/2000 | Krishnan | |
| 6,175,124 | B1 | 1/2001 | Cole et al. | |
| 6,184,651 | B1 | 2/2001 | Fernandez et al. | |
| 6,265,789 | B1 | 7/2001 | Honda et al. | |
| 6,275,681 | B1 | 8/2001 | Vega et al. | |
| 6,291,901 | B1 | 9/2001 | Cefo | |
| 6,317,338 | B1 | 11/2001 | Boys | |
| 6,337,628 | B2 | 1/2002 | Campana, Jr. | |
| 6,341,076 | B1 | 1/2002 | Kadatskyy et al. | |
| 6,411,824 | B1 | 6/2002 | Eidson | |
| 6,437,685 | B2 | 8/2002 | Hanaki | |
| 6,507,152 | B2 | 1/2003 | Matsumoto et al. | |
| 6,523,493 | B1 | 2/2003 | Brcka | |
| 6,556,054 | B1 | 4/2003 | Goodman et al. | |
| 6,633,026 | B2 | 10/2003 | Tuominen | |
| 6,636,146 | B1 | 10/2003 | Wehoski | |
| 6,670,864 | B2 | 12/2003 | Hyvonen et al. | |
| 6,798,716 | B1 | 9/2004 | Charych | |
| 6,803,744 | B1 | 10/2004 | Sabo | |
| 6,879,076 | B2 | 4/2005 | Long | |
| 6,891,287 | B2 | 5/2005 | Moret | |
| 6,912,137 | B2 | 6/2005 | Berghegger | |
| 6,960,968 | B2 | 11/2005 | Odendaal et al. | |
| 6,965,352 | B2 | 11/2005 | Ohara et al. | |
| 6,967,462 | B1 | 11/2005 | Landis | |
| 6,972,542 | B2 | 12/2005 | Patino et al. | |
| 6,972,543 | B1 | 12/2005 | Wells | |
| 7,012,405 | B2 | 3/2006 | Nishida et al. | |
| 7,068,991 | B2 | 6/2006 | Parise | |
| 7,076,206 | B2 | 7/2006 | Elferich et al. | |
| 7,095,301 | B2 | 8/2006 | Hidaka et al. | |
| 7,110,462 | B2 | 9/2006 | Monsen | |
| 7,116,018 | B2 | 10/2006 | Strobl | |
| 7,142,811 | B2 | 11/2006 | Terranova et al. | |
| 7,154,451 | B1 | 12/2006 | Sievenpiper | |
| 7,164,344 | B2 | 1/2007 | Deguchi et al. | |
| 7,167,139 | B2 | 1/2007 | Kim et al. | |
| 7,180,265 | B2 | 2/2007 | Naskali et al. | |
| 7,180,291 | B2 | 2/2007 | Chmielewski et al. | |
| 7,209,792 | B1 | 4/2007 | Parramon et al. | |
| 7,212,414 | B2 | 5/2007 | Baarman | |
| 7,215,061 | B2 | 5/2007 | Kihara et al. | |
| 7,248,165 | B2 | 7/2007 | Collins et al. | |
| 7,256,532 | B2 * | 8/2007 | Viehland et al. | 310/358 |
| 7,262,701 | B1 | 8/2007 | Nguyen | |
| 7,380,150 | B2 | 5/2008 | Meier et al. | |
| 7,423,518 | B2 | 9/2008 | Yamada | |
| 7,511,500 | B2 * | 3/2009 | Schiano et al. | 324/318 |
| 7,525,283 | B2 * | 4/2009 | Cheng et al. | 320/108 |
| 7,554,316 | B2 * | 6/2009 | Stevens et al. | 323/355 |
| 7,598,646 | B2 | 10/2009 | Cleveland | |
| 7,675,197 | B2 | 3/2010 | Tetlow | |
| 7,676,263 | B2 | 3/2010 | Harris et al. | |
| 7,684,868 | B2 | 3/2010 | Tai et al. | |
| 7,688,036 | B2 | 3/2010 | Yarger et al. | |
| 7,741,734 | B2 * | 6/2010 | Joannopoulos et al. | 307/104 |
| 7,755,552 | B2 | 7/2010 | Schantz et al. | |
| 7,760,151 | B2 * | 7/2010 | Poilasne et al. | 343/742 |
| 7,777,396 | B2 | 8/2010 | Rastegar et al. | |
| 7,825,543 | B2 | 11/2010 | Karalis et al. | |
| 7,839,124 | B2 | 11/2010 | Yamazaki et al. | |
| 7,844,306 | B2 | 11/2010 | Shearer et al. | |
| 7,868,482 | B2 | 1/2011 | Greene et al. | |
| 7,885,050 | B2 * | 2/2011 | Lee | 361/113 |
| 8,055,310 | B2 * | 11/2011 | Beart et al. | 455/572 |
| 8,159,412 | B2 * | 4/2012 | Yun et al. | 343/890 |
| 2001/0012208 | A1 | 8/2001 | Boys | |
| 2001/0026244 | A1 * | 10/2001 | Ieda et al. | 343/867 |
| 2001/0029167 | A1 | 10/2001 | Takeda et al. | |
| 2002/0017979 | A1 | 2/2002 | Krause et al. | |
| 2002/0036977 | A1 | 3/2002 | Lenssen et al. | |
| 2002/0057161 | A1 | 5/2002 | Katsura et al. | |
| 2002/0057584 | A1 | 5/2002 | Brockmann | |
| 2002/0190908 | A1 | 12/2002 | Andrews et al. | |
| 2003/0090353 | A1 | 5/2003 | Robinson et al. | |
| 2003/0162566 | A1 | 8/2003 | Shapira et al. | |
| 2003/0174099 | A1 | 9/2003 | Bauer et al. | |
| 2003/0193438 | A1 | 10/2003 | Yoon | |
| 2003/0199778 | A1 | 10/2003 | Mickle et al. | |
| 2004/0001029 | A1 | 1/2004 | Parsche et al. | |
| 2004/0130425 | A1 | 7/2004 | Dayan et al. | |
| 2004/0150521 | A1 | 8/2004 | Stilp | |
| 2004/0160323 | A1 | 8/2004 | Stilp | |
| 2004/0204781 | A1 | 10/2004 | Hsien | |
| 2004/0212500 | A1 | 10/2004 | Stilp | |
| 2004/0227002 | A1 | 11/2004 | Watanabe | |
| 2004/0227057 | A1 | 11/2004 | Tuominen et al. | |
| 2004/0227619 | A1 | 11/2004 | Watanabe | |
| 2005/0007239 | A1 | 1/2005 | Woodard et al. | |
| 2005/0017677 | A1 | 1/2005 | Burton et al. | |
| 2005/0029351 | A1 | 2/2005 | Yoshinaga et al. | |
| 2005/0043055 | A1 | 2/2005 | Vance | |
| 2005/0057422 | A1 | 3/2005 | Deguchi et al. | |
| 2005/0075697 | A1 | 4/2005 | Olson et al. | |
| 2005/0104457 | A1 | 5/2005 | Jordan et al. | |
| 2005/0125093 | A1 | 6/2005 | Kikuchi et al. | |
| 2005/0127867 | A1 | 6/2005 | Calhoon et al. | 320/108 |
| 2005/0131495 | A1 | 6/2005 | Parramon et al. | 607/61 |
| 2005/0194926 | A1 | 9/2005 | Di Stefano | |
| 2005/0273143 | A1 | 12/2005 | Kanzius et al. | |
| 2006/0017438 | A1 | 1/2006 | Mullen et al. | |
| 2006/0061325 | A1 | 3/2006 | Tang et al. | |
| 2006/0071790 | A1 | 4/2006 | Duron et al. | |
| 2006/0094449 | A1 | 5/2006 | Goldberg | |
| 2006/0103355 | A1 | 5/2006 | Patino et al. | |
| 2006/0113955 | A1 | 6/2006 | Nunally | |
| 2006/0125703 | A1 | 6/2006 | Ma et al. | |
| 2006/0145659 | A1 | 7/2006 | Patino et al. | |
| 2006/0145660 | A1 | 7/2006 | Black et al. | |
| 2006/0159536 | A1 | 7/2006 | Pu | |
| 2006/0160517 | A1 | 7/2006 | Yoon | |
| 2006/0164312 | A1 * | 7/2006 | Mathieu | 343/748 |
| 2006/0208903 | A1 | 9/2006 | Loh et al. | |
| 2006/0239043 | A1 | 10/2006 | Ohbo | |
| 2006/0273756 | A1 | 12/2006 | Bowling et al. | |
| 2007/0010295 | A1 | 1/2007 | Greene et al. | |
| 2007/0046433 | A1 | 3/2007 | Mukherjee | |
| 2007/0054705 | A1 | 3/2007 | Liow et al. | |
| 2007/0060221 | A1 | 3/2007 | Burgan et al. | |
| 2007/0082611 | A1 | 4/2007 | Terranova et al. | |
| 2007/0091006 | A1 | 4/2007 | Thober et al. | |
| 2007/0096910 | A1 | 5/2007 | Waters | |
| 2007/0103291 | A1 | 5/2007 | Adams | |
| 2007/0105524 | A1 | 5/2007 | Fullam et al. | |
| 2007/0114945 | A1 | 5/2007 | Mattaboni et al. | |
| 2007/0120678 | A1 | 5/2007 | Posamentier | |
| 2007/0126395 | A1 | 6/2007 | Suchar | |
| 2007/0126650 | A1 | 6/2007 | Guenther | |
| 2007/0135078 | A1 | 6/2007 | Ljung | |
| 2007/0139000 | A1 | 6/2007 | Kozuma et al. | |
| 2007/0145830 | A1 | 6/2007 | Lee et al. | |
| 2007/0146218 | A1 | 6/2007 | Turner et al. | |

| | | | | |
|---|---|---|---|---|
| 2007/0156204 | A1 | 7/2007 | Denker et al. | |
| 2007/0164414 | A1 | 7/2007 | Dokai et al. | |
| 2007/0171681 | A1 | 7/2007 | Baarman | |
| 2007/0178945 | A1 | 8/2007 | Cook et al. | |
| 2007/0188326 | A1 | 8/2007 | Pluss et al. | |
| 2007/0205881 | A1 | 9/2007 | Breed | |
| 2007/0214940 | A1 | 9/2007 | Stoneback | |
| 2007/0222542 | A1 | 9/2007 | Joannopoulos | |
| 2007/0281625 | A1 | 12/2007 | Boys | |
| 2007/0296393 | A1 | 12/2007 | Malpas et al. | |
| 2007/0298846 | A1 | 12/2007 | Greene et al. | |
| 2008/0003963 | A1 | 1/2008 | Turner | |
| 2008/0014897 | A1 | 1/2008 | Cook et al. | |
| 2008/0054638 | A1 | 3/2008 | Greene et al. | |
| 2008/0067874 | A1 | 3/2008 | Tseng | |
| 2008/0093934 | A1 | 4/2008 | Kato | |
| 2008/0108862 | A1 | 5/2008 | Jordan et al. | |
| 2008/0122294 | A1 | 5/2008 | Simon et al. | |
| 2008/0122297 | A1 | 5/2008 | Arai | |
| 2008/0129147 | A1 | 6/2008 | Thiesen et al. | |
| 2008/0167755 | A1 | 7/2008 | Curt | |
| 2008/0186129 | A1 | 8/2008 | Fitzgibbon | |
| 2008/0191897 | A1 | 8/2008 | Mccollough | 340/625.22 |
| 2008/0211320 | A1 | 9/2008 | Cook et al. | |
| 2008/0211455 | A1 | 9/2008 | Park et al. | |
| 2008/0225564 | A1 | 9/2008 | Bohm et al. | |
| 2008/0293446 | A1 | 11/2008 | Rofougaran | |
| 2008/0296978 | A1 | 12/2008 | Finkenzeller et al. | |
| 2008/0309452 | A1 | 12/2008 | Zeine | |
| 2009/0002175 | A1 | 1/2009 | Waters | |
| 2009/0009177 | A1 | 1/2009 | Kim et al. | |
| 2009/0026907 | A1 | 1/2009 | Davidowitz et al. | |
| 2009/0045772 | A1 | 2/2009 | Cook et al. | |
| 2009/0051224 | A1 | 2/2009 | Cook et al. | |
| 2009/0052721 | A1 | 2/2009 | Dabrowski | |
| 2009/0058361 | A1 | 3/2009 | John | |
| 2009/0072627 | A1* | 3/2009 | Cook et al. | 307/104 |
| 2009/0102296 | A1 | 4/2009 | Greene et al. | |
| 2009/0102419 | A1 | 4/2009 | Gwon et al. | |
| 2009/0109102 | A1 | 4/2009 | Dokai et al. | |
| 2009/0111531 | A1 | 4/2009 | Cui et al. | |
| 2009/0121713 | A1 | 5/2009 | Van Helvoort | |
| 2009/0146892 | A1 | 6/2009 | Shimizu et al. | |
| 2009/0167449 | A1 | 7/2009 | Cook et al. | |
| 2009/0204170 | A1 | 8/2009 | Hastings et al. | |
| 2009/0218884 | A1 | 9/2009 | Soar | |
| 2009/0243394 | A1 | 10/2009 | Levine | |
| 2009/0273242 | A1 | 11/2009 | Cook | |
| 2009/0299918 | A1 | 12/2009 | Cook et al. | |
| 2009/0308933 | A1 | 12/2009 | Osada | |
| 2010/0013434 | A1 | 1/2010 | Taylor-Haw et al. | |
| 2010/0068998 | A1 | 3/2010 | Zyambo et al. | |
| 2010/0109445 | A1 | 5/2010 | Kurs et al. | |
| 2010/0134366 | A1* | 6/2010 | Yu | 343/742 |
| 2010/0176936 | A1 | 7/2010 | Garber et al. | |
| 2010/0277387 | A1 | 11/2010 | Schantz et al. | |
| 2010/0289331 | A1 | 11/2010 | Shionoiri et al. | |
| 2010/0289449 | A1 | 11/2010 | Elo | |
| 2010/0315045 | A1 | 12/2010 | Zeine | |
| 2011/0031821 | A1 | 2/2011 | Greene et al. | |
| 2011/0050166 | A1 | 3/2011 | Cook et al. | |
| 2011/0069516 | A1 | 3/2011 | Greene et al. | |
| 2011/0074349 | A1 | 3/2011 | Ghovanloo | |

FOREIGN PATENT DOCUMENTS

| | | | |
|---|---|---|---|
| CN | 2582188 | Y | 10/2003 |
| DE | 4023412 | | 2/1992 |
| DE | 19509918 | | 9/1996 |
| DE | 19729722 | | 1/1999 |
| DE | 19938460 | | 2/2001 |
| DE | 102004009896 | | 9/2005 |
| DE | 102005053111 | | 5/2007 |
| EP | 0568920 | | 11/1993 |
| EP | 298707 | | 9/1994 |
| EP | 724308 | | 7/1996 |
| EP | 773509 | | 4/2002 |
| EP | 1302822 | | 4/2003 |
| EP | 1315051 | | 5/2003 |
| EP | 1003266 | | 4/2006 |
| EP | 1413975 | | 5/2007 |
| EP | 1892799 | | 2/2008 |
| GB | 1280516 | | 7/1972 |
| GB | 1343071 | | 1/1974 |
| GB | 2070298 | | 9/1981 |
| GB | 2318696 | | 4/1998 |
| JP | 57032144 | | 2/1982 |
| JP | 62071430 | A | 4/1987 |
| JP | 1298901 | A | 12/1989 |
| JP | 4115606 | A | 4/1992 |
| JP | 04271201 | | 9/1992 |
| JP | 5038232 | A | 2/1993 |
| JP | 05183318 | | 7/1993 |
| JP | 6044207 | A | 2/1994 |
| JP | 06133476 | | 5/1994 |
| JP | 6044207 | U | 6/1994 |
| JP | 6303726 | | 10/1994 |
| JP | 6327172 | A | 11/1994 |
| JP | 6339232 | | 12/1994 |
| JP | 8033244 | A | 2/1996 |
| JP | 8079976 | | 3/1996 |
| JP | 8088942 | | 4/1996 |
| JP | 8130840 | A | 5/1996 |
| JP | 8162689 | A | 6/1996 |
| JP | 9037475 | | 2/1997 |
| JP | 9182322 | | 7/1997 |
| JP | 10097931 | | 4/1998 |
| JP | 10225020 | | 8/1998 |
| JP | 11143600 | | 5/1999 |
| JP | 11191146 | | 7/1999 |
| JP | 11215802 | A | 8/1999 |
| JP | 11332135 | | 11/1999 |
| JP | 2000078763 | | 3/2000 |
| JP | 2000175379 | | 6/2000 |
| JP | 2000217279 | | 8/2000 |
| JP | 2001024548 | A | 1/2001 |
| JP | 2001197672 | | 7/2001 |
| JP | 2001238372 | A | 8/2001 |
| JP | 2001264432 | A | 9/2001 |
| JP | 2001526374 | A | 12/2001 |
| JP | 2002017058 | A | 1/2002 |
| JP | 2002078247 | A | 3/2002 |
| JP | 2002508916 | A | 3/2002 |
| JP | 2002320347 | | 10/2002 |
| JP | 2003047177 | A | 2/2003 |
| JP | 2003069335 | A | 3/2003 |
| JP | 2003189507 | A | 7/2003 |
| JP | 2004187429 | A | 7/2004 |
| JP | 2005045298 | A | 2/2005 |
| JP | 2005137040 | | 5/2005 |
| JP | 2005261187 | A | 9/2005 |
| JP | 2006042519 | | 2/2006 |
| JP | 2006510101 | A | 3/2006 |
| JP | 2006115592 | A | 4/2006 |
| JP | 2006149163 | A | 6/2006 |
| JP | 2008508842 | A | 3/2008 |
| JP | 2009501510 | A | 1/2009 |
| JP | 2010539821 | A | 12/2010 |
| KR | 102000017058 | | 3/2000 |
| KR | 1020010000674 | | 1/2001 |
| KR | 1020010030472 | | 4/2001 |
| KR | 20020064451 | A | 8/2002 |
| KR | 20050016879 | A | 2/2005 |
| KR | 1020050019926 | | 3/2005 |
| KR | 20060070795 | A | 6/2006 |
| KR | 20070017804 | A | 2/2007 |
| WO | WO8807732 | | 10/1988 |
| WO | WO9619028 | | 6/1996 |
| WO | WO9857413 | A1 | 12/1998 |
| WO | WO9930090 | A1 | 6/1999 |
| WO | WO9950780 | | 10/1999 |
| WO | WO9950806 | | 10/1999 |
| WO | WO0167413 | | 9/2001 |
| WO | WO02060215 | | 8/2002 |
| WO | WO03077364 | A2 | 9/2003 |
| WO | WO2004038887 | | 5/2004 |
| WO | WO2004052563 | | 6/2004 |
| WO | WO2004077550 | | 9/2004 |
| WO | WO2005086279 | | 9/2005 |

| | | | |
|---|---|---|---|
| WO | WO2006006636 | A1 | 1/2006 |
| WO | WO2006011769 | A1 | 2/2006 |
| WO | WO2006031785 | | 3/2006 |
| WO | WO2007008646 | A2 | 1/2007 |
| WO | WO2007048052 | | 4/2007 |
| WO | WO2007077442 | | 7/2007 |

OTHER PUBLICATIONS

"Efficient wireless non-radiative mid-range energy transfer", MITpaper, publication and date unknown, believed to be 2007.

"Wireless Power Transfer via Strongly Coupled Magnetic Resonances", Kurs et al, Science Express, Jun. 7, 2007.

"Wireless Power Transfer via Strongly Coupled Magnetic Resonances", Kurs et al, scimag.org, Jul. 6, 2007.

Ozawa, R., et al., "Wireless Energy Transmission for Micro Aerial Vehicles Using a Microwave Phased Array," 3rd International Energy Conversion Engineering Conference, Aug. 15-18, 2005, San Francisco, CA, pp. 1-6.

Yates et al., "Optimal transmission frequency for ultralow-power short-range radio links", Source: IEEE Transactions on Circuits and Systems I: Fundamental Theory and Applications, v 51, n 7, 1405-13, Jul. 2004; ISSN: 1057-7122; DOI: 10.1109/TCSI.2004.830696; Publisher: IEEE, USA Author affiliation: Dept. of Electr. & Electron. Eng., Imperial Coll. London, UK.

Finkenzeller, "RFID Handbook: Fundamentals and Applications in Contactless Smart Cards and Identification," Second Edition, Translated by Rachel Waddington, 2003, John Wiley & Sons Ltd., pp. 106-111.

Chunbo et al.,"Research on the topology of wireless energy transfer device", Sch. of Electr. Eng. & Autom., Harbin Inst. of Technol., Harbin This paper appears in: Vehicle Power and Propulsion Conference, 2008. VPPC '08. IEEE Issue Date : Sep. 3-5, 2008 on pp. 1 Print ISBN: 978-1-4244-1848-0 INSPEC Accession No. 10394615 Digital Object Identifier : 10.1109/VPPC.2008.4677798 Date of Current Version : Nov. 18, 2008.

Dong-Gi Youn et al, "A Study on the Fundamental Transmission Experiment for Wireless Power Transmission System," 1999 IEEE Conference, TENCON 99, vol. 2, pp. 1419-1422, Sep. 1999.

Harrist, Wireless battery charging system using radio frequency energy harvesting, Master of Science Thesis, University of Pittsburgh, 2004.

McSpadden et al, "A High Conversion Efficiency 5.8 GHz Rectenna," 1997 IEEE Microwave Symposium, vol. 2, pp. 547-550, Jun. 1997.

McSpadden et al, "Theoretical and Experimental Investigation of a Rectenna Element for Microwave Power Transmission," 1992 IEEE Transactions on Microwave Theory and Techniques, vol. 40, pp. 2359-2366, Dec. 1992.

Karalis et al., "Efficient wireless non-radiative mid-range energy transfer", Science Direct, Annals of Physics, 323(1),34-48, Apr. 17, 2007. doi:10.1016/j.aop.2007.04.27.

Kim et al., "Electrically Small Magnetic Dipole Antennas With Quality Factors Approaching the Chu Lower Bound", Antennas and Propagation, IEEE Transactions on vol. 58 Issue: 6 Publication Date: Jun. 2010 pp. 1898-1906 Digital Object Identifier: 10.1109/TAP.2010.2046864.

Miranda et al.,"Wireless power transfer using weakly coupled magnetostatic resonators", Energy Conversion Congress and Exposition (ECCE), 2010 IEEE Digital Object Identifier: 10.1109/ECCE.2010.5617728 Publication Year: 2010 , pp. 4179-4186 IEEE Conferences.

Myers et al., "A transcutaneous power transformer," Trans. Amer. Soc. Artif. Inter. Organs, vol. 14, 1968, pp. 210-219.

Shinohara et al, "Experimental Study of Large Rectenna Array for Microwave Energy Transmission," 1998 IEEE Transactions on Microwave Theory and Techniques, vol. 46, pp. 261-268, Mar. 1998.

Onizuka, et al., A design methodology of chip-to-chip wireless power transmission system, Univ. of Tokyo, International Conference on Integrated Circuit Design and Technology, 2007 (ICICDT '07), IEEE, May-Jun. 2007, pp. 1-4.

Schuder et al., "High Level electromagnetic energy transfer through a closed wall", Inst.Radio Engrs. Int.Conf Record 9, pp. 119-126, 1961.

Schuder, "Powering an artificial heart:Birth of the inductively coupled-radio frequency system in 1960", Artificial organs , vol. 26, No. 11, 2002, pp. 909-915.

Tae-Whan Yoo et al, "Theoretical and Experimental Development of 10 and 35 GHz Rectennas," 1992 IEEE Transactions on Microwave Theory and Techniques, vol. 40, pp. 1259-1266, Jun. 1992.

Sekitani et al, "A Large-area Wireless Power-Transmission Sheet Using Printed Organic Transistors and Plastic MEMS Switches," Nature Materials Letter, pp. 413-417; Jan. 2007.

Dudek, et al., "High permeability micro-magneto-mechanical systems," International Journal of Applied Electromagnetics and Mechanics (2007), vol. 25, pp. 103-108.

International Search Report and Written Opinion—PCT/US2008/076554—ISA/EPO—Jan. 7, 2009.

Kim, et al., Switchable polymer-based thin film coils as a power module wireless neural interfaces, Sensors and Actuators, vol. A 136, Issue 1, May 2007 (available online Nov. 27, 2006), pp. 467-474.

Bayrashev, Andrey, et al., "Low frequency wireless powering of microsystems using piezoelectric-magnetostrictive laminate composites," Sensors & Actuators A: Physical, Sep. 2004, vol. 114, Issue 2/3, pp. 244-249.

* cited by examiner

Air Solenoid $$f_{res} = \frac{1}{2\pi\sqrt{L_1 C_1}} =$$

$$Q = \frac{1}{R_1}\sqrt{\frac{L_1}{C_1}} =$$

High

Low with the $\gamma = -\frac{m}{J}$ Gyromagnetic Ratio m : the Magnitude of the Magnetic Dipole Moment
J : the Magnitude of the Angular Momentum

TRANSMITTERS AND RECEIVERS FOR WIRELESS ENERGY TRANSFER

CROSS-REFERENCE TO RELATED APPLICATIONS

This application claims priority from provisional application No. 60/973,100, filed Sep. 17, 2007, the entire contents of which disclosure is herewith incorporated by reference. This application is a continuation-in-part of U.S. patent application Ser. No. 12/018,069, filed Jan. 22, 2008, which claims the benefit of U.S. Provisional App. No. 60/904,628, filed Mar. 2, 2007. The specification of U.S. patent application Ser. No. 12/018,069 is incorporated herein by reference in its entirety.

BACKGROUND

It is desirable to transfer electrical energy from a source to a destination without the use of wires to guide the electromagnetic fields. A difficulty of previous attempts has been low efficiency together with an inadequate amount of delivered power.

Our previous applications and provisional applications, including, but not limited to, U.S. patent application Ser. No. 12/018,069, filed Jan. 22, 2008, entitled "Wireless Apparatus and Methods", the entire contents of the disclosure of which is herewith incorporated by reference, describe wireless transfer of power.

The system can use transmit and receiving antennas that are preferably resonant antennas, which are substantially resonant, e.g., within 5%, 10% of resonance, 15% of resonance, or 20% of resonance. The antenna(s) are preferably of a small size to allow it to fit into a mobile, handheld device where the available space for the antenna may be limited, and the cost may be a factor. An efficient power transfer may be carried out between two antennas by storing energy in the near field of the transmitting antenna, rather than sending the energy into free space in the form of a travelling electromagnetic wave. Antennas with high quality factors can be used. Two high-Q antennas are placed such that they react similarly to a loosely coupled transformer, with one antenna inducing power into the other. The antennas preferably have Qs that are greater than 1000.

SUMMARY

The present application describes transfer of energy from a power source to a power destination via electromagnetic field coupling. Embodiments describe techniques for maximizing the energy transfer.

BRIEF DESCRIPTION OF THE DRAWINGS

These and other aspects will now be described in detail with reference to the accompanying drawings.

FIGS. 13A and 3B show the different ways that antennas can be integrated into the package of such a device.

DETAILED DESCRIPTION

Figure 1:
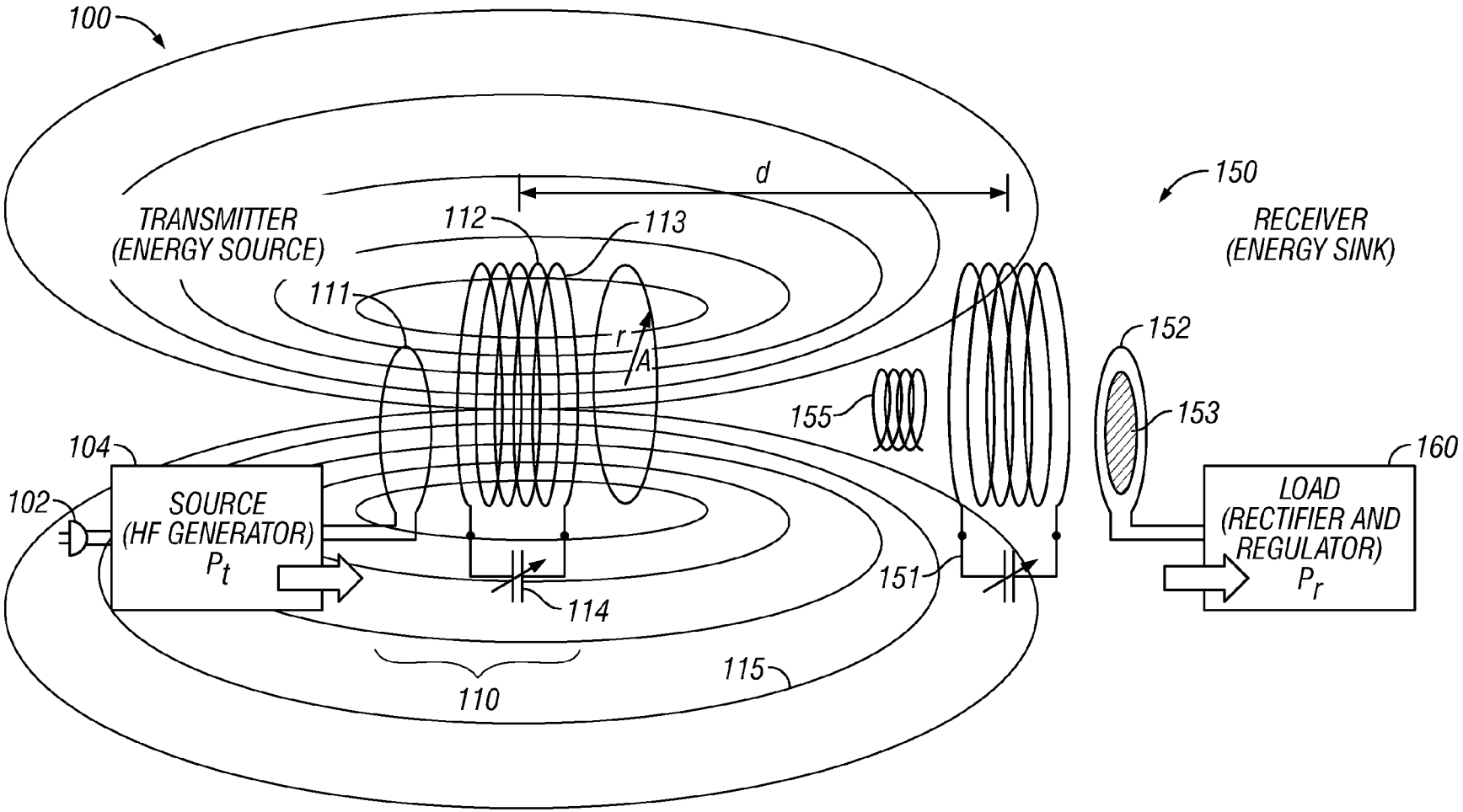
FIG. 1 shows a basic block diagram of a wireless power systems.

A basic embodiment is shown in FIG. 1. A power transmitter assembly 100 receives power from a source, for example, an AC plug 102. A frequency generator 104 is used to couple the energy to an antenna 110, here a resonant antenna. The antenna 110 includes an inductive loop 111, which is inductively coupled to a high Q resonant antenna part 112. The resonant antenna includes a number N of coil loops 113 each loop having a radius $r_A$. A capacitor 114, here shown as a variable capacitor, is in series with the coil 113, forming a resonant loop. In the embodiment, the capacitor is a totally separate structure from the coil, but in certain embodiments, the self capacitance of the wire forming the coil can form the capacitance 114.

The frequency generator 104 can be preferably tuned to the antenna 110, and also selected for FCC compliance.

This embodiment uses a multidirectional antenna. 115 shows the energy as output in all directions. The antenna 100 is non-radiative, in the sense that much of the output of the antenna is not electromagnetic radiating energy, but is rather a magnetic field which is more stationary. Of course, part of the output from the antenna will in fact radiate.

Another embodiment may use a radiative antenna.

A receiver 150 includes a receiving antenna 155 placed a distance D away from the transmitting antenna 110. The receiving antenna is similarly a high Q resonant coil antenna 151 having a coil part and capacitor, coupled to an inductive coupling loop 152 wound around a ferrite core 153. The output of the coupling loop 152 is rectified in a rectifier 160, and applied to a load. That load can be any type of load, for example a resistive load such as a light bulb, or an electronic device load such as an electrical appliance, a computer, a rechargeable battery, a music player or an automobile.

The energy can be transferred through either electrical field coupling or magnetic field coupling, although magnetic field coupling is predominantly described herein as an embodiment.

Electrical field coupling provides an inductively loaded electrical dipole that is an open capacitor or dielectric disk. Extraneous objects may provide a relatively strong influence on electric field coupling. Magnetic field coupling may be preferred, since extraneous objects in a magnetic field have the same magnetic properties as "empty" space.

The embodiment describes a magnetic field coupling using a capacitively loaded magnetic dipole. Such a dipole is formed of a wire loop forming at least one loop or turn of a coil, in series with a capacitor that electrically loads the antenna into a resonant state.

Wireless energy transfer, however, requires an analysis of the efficiency. The efficiency data can be expressed as $$\eta = \frac{P_r}{P_t}$$

where $P_r$ is power output at the receive antenna and $P_t$ is power input at the transmit antenna.

The inventors considered both electrical field coupling and magnetic field coupling, and have decided that magnetic field coupling may be more promising for wireless power transfer. While electrical field coupling may be promising for proximity power transmission, a significant problem from electrical field coupling is that it shows a relatively strong influence from extraneous objects. Electrical field coupling uses an inductively loaded electrical dipole e.g. an open capacitor or dielectric disc.

Magnetic field coupling, as used according to embodiments, uses a capacitively loaded magnetic dipole antenna as described in the embodiments. This antenna can include a conductive single loop or series of loops with a capacitor attached across the inductance. Magnetic field coupling may have the advantage of relatively weak influence from extraneous objects.

Figure 2B:
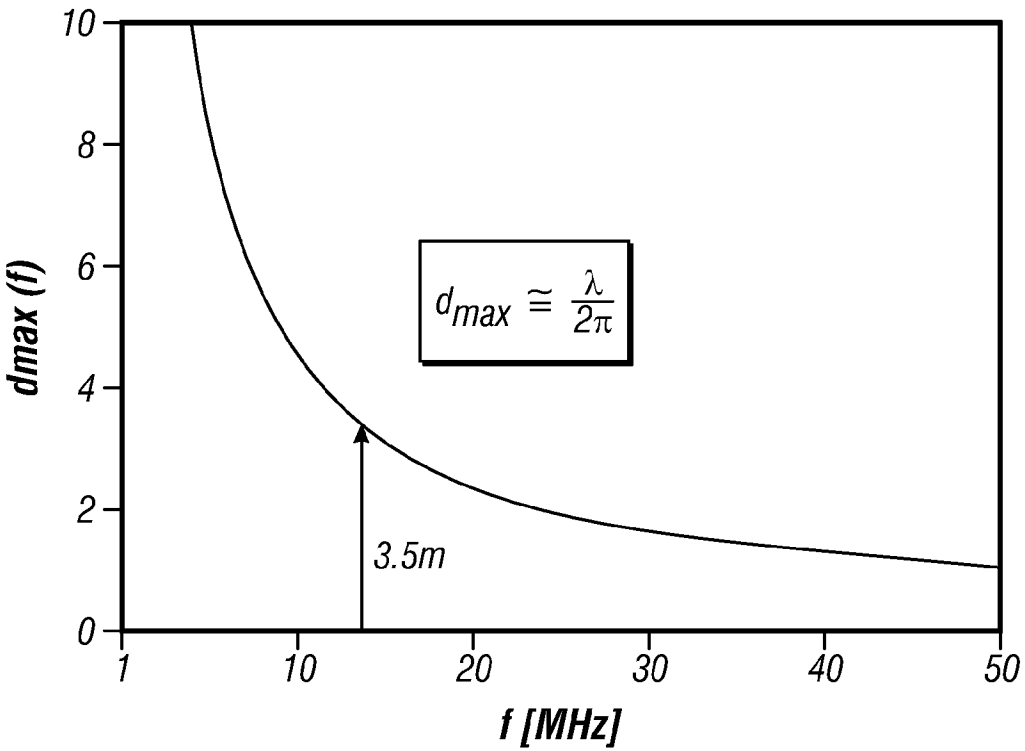
FIGS. 2A and 2B show block diagrams showing distance limit of non-radiative wireless transfers.
Figure 2A:
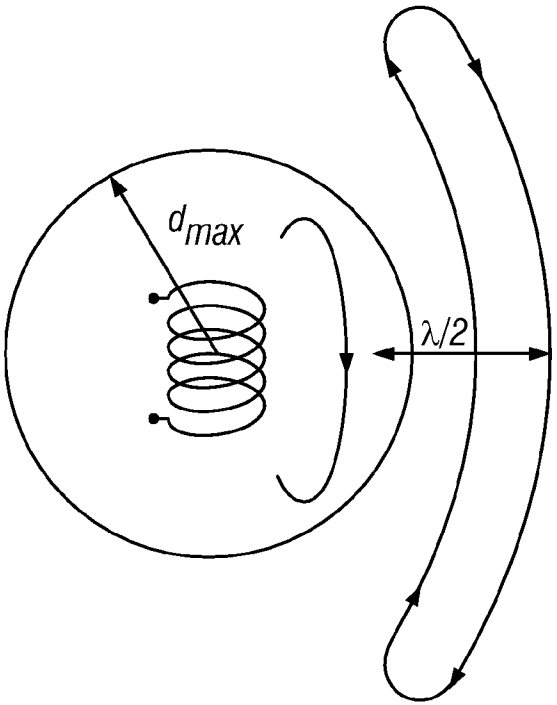

FIGS. 2A and 2B illustrate representative "near field" conditions for non-radiative energy transfer. The distance between a coil that is transmitting the information, and the receiver of the information is plotted in FIG. 2B for the arrangement shown in FIG. 2A. Of course, this energy transfer characteristic is highly dependent on different parameters, including the frequency that is used and the characteristics of the antenna and receiver. However, for a specified set of characteristics shown in FIGS. 2A and 2B, a distance curve shown in FIG. 2B can be obtained, showing a reasonable amount of energy transfer at 3½ m.

Figure 3:
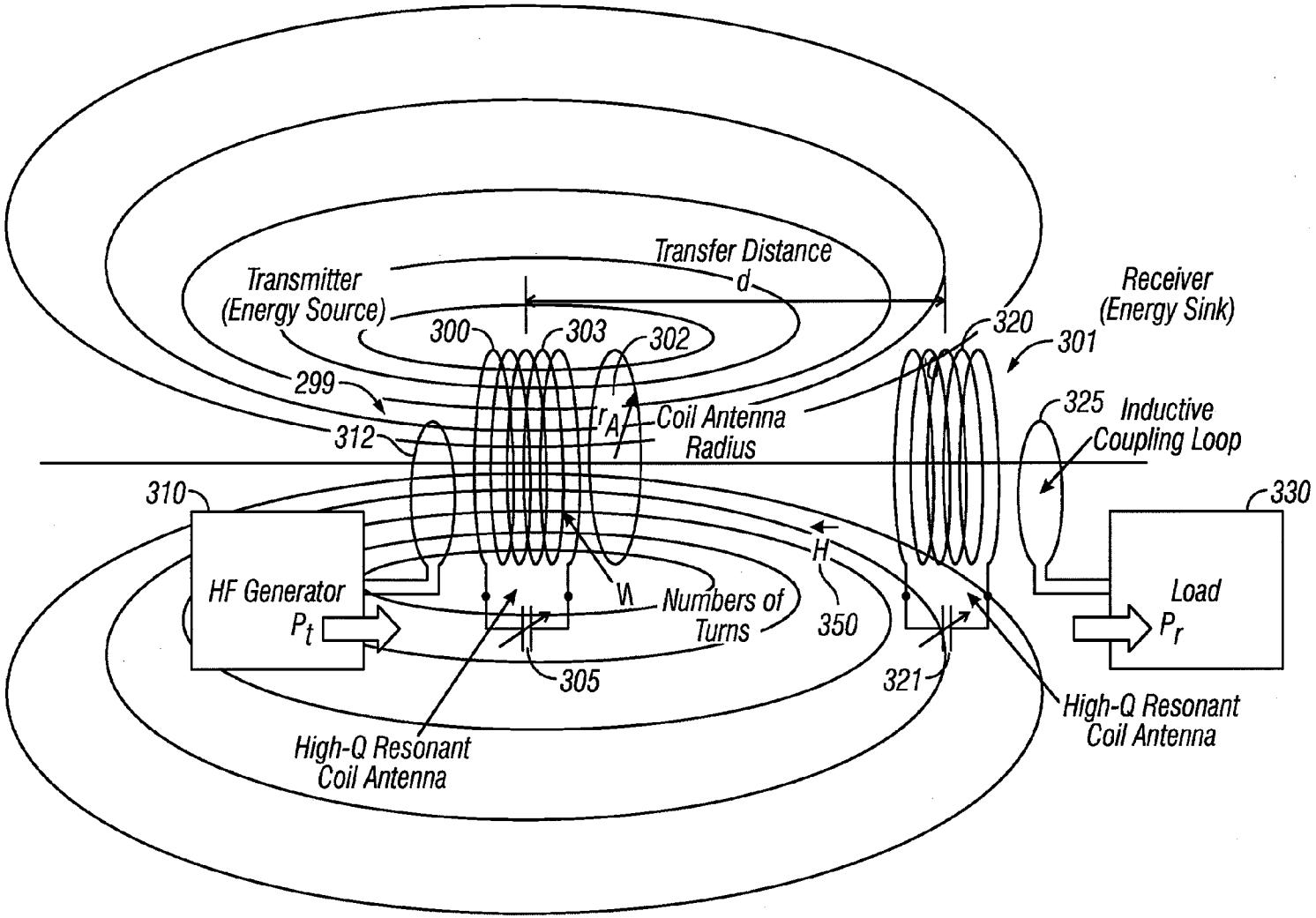
FIG. 3 shows wireless transfer using resonant coil antenna.

A desirable feature of this technique is to use resonant coil antennas, with an inductance coil 300 in the series with a capacitance 305. FIG. 3 illustrates a receiver 301 receiving power from the transmitter that has been wirelessly transmitted using a magnetic field and resonant coil antennas. The transmitter 299 includes a high frequency generator 310 which generates a power Pt into a coupling loop 312. The coupling loop couples this power to a main antenna 300. The main antenna 300 has a coil radius 302 of $r_A$, and a number of turns N. The antenna includes a coil portion 303 in series with a capacitance 305. The LC value of the coil and capacitance are tuned to be resonant to the driving frequency, here 13.56 MHz preferably. This creates a magnetic field H shown as 350.

A receiving coil 320 has a capacitance 321 connected in series therewith, in the area of the magnetic field, located a transfer distance d away from the transmit antenna. The received energy from the receiving antenna 320, 321 is coupled to coupling loop 325, and sent to a load 330. The load may include, for example, power rectification circuitry therein.

The loss resistance within the circuit is dependent on radiation resistance, eddy current losses, skin and proximity effect, and dielectric losses.

Figure 4A:
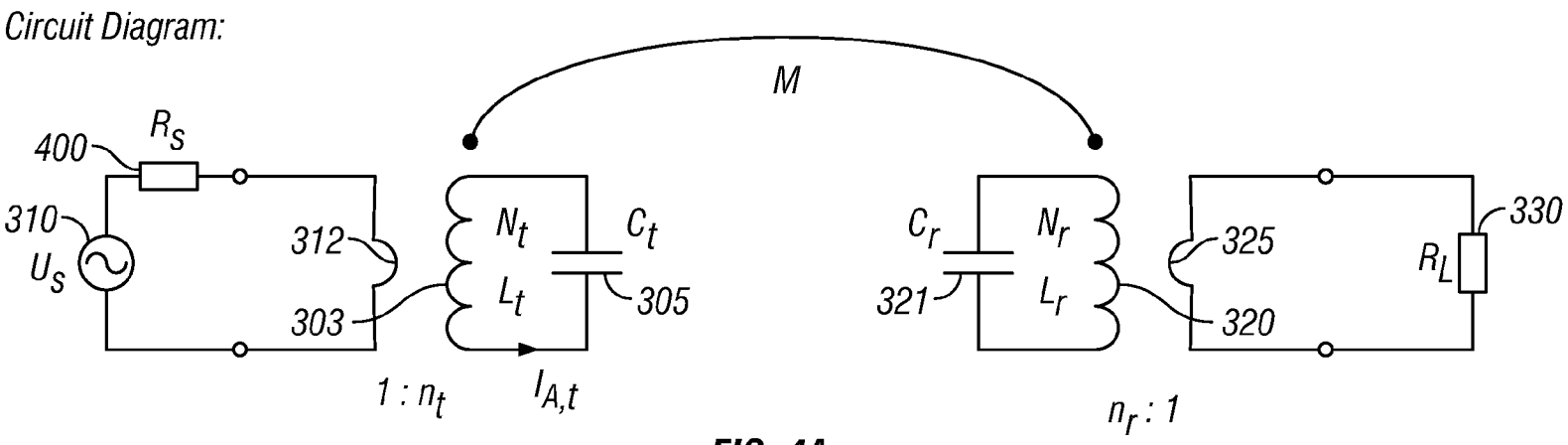
FIGS. 4A and 4B illustrate equivalent circuit diagrams and the loss circuits equivalent to these diagrams.
Figure 4B:
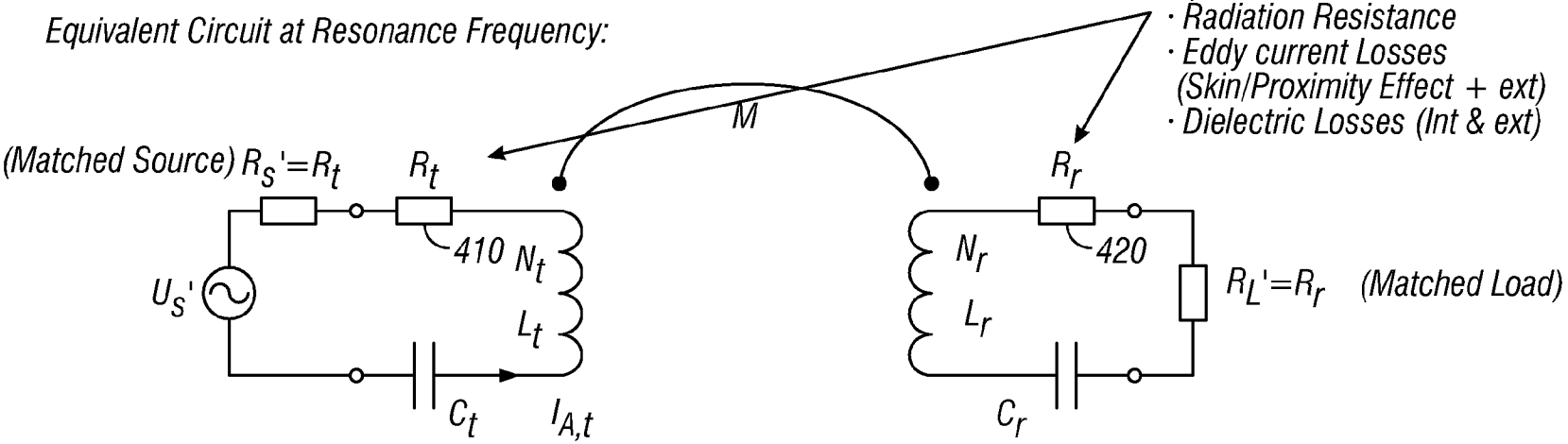

FIGS. 4A and 4B illustrate equivalent circuit diagrams, and the loss circuits equivalent to these diagrams. The equivalent circuit in FIG. 4A shows equivalent circuits to those discussed in FIG. 3A, including an equivalent diagram of the HF generator 310, coupling coil 312, main coil 303, capacitance 305, as well as receive capacitance 321, received coil 320, received coupling coil 325, and load 330. FIG. 4A also shows, however, a equivalent loss resistance Rs 400, as well as eddy current losses and others. FIG. 4B illustrates the radiation resistance 410, the eddy current losses 420, and other effects.

Figure 4C:
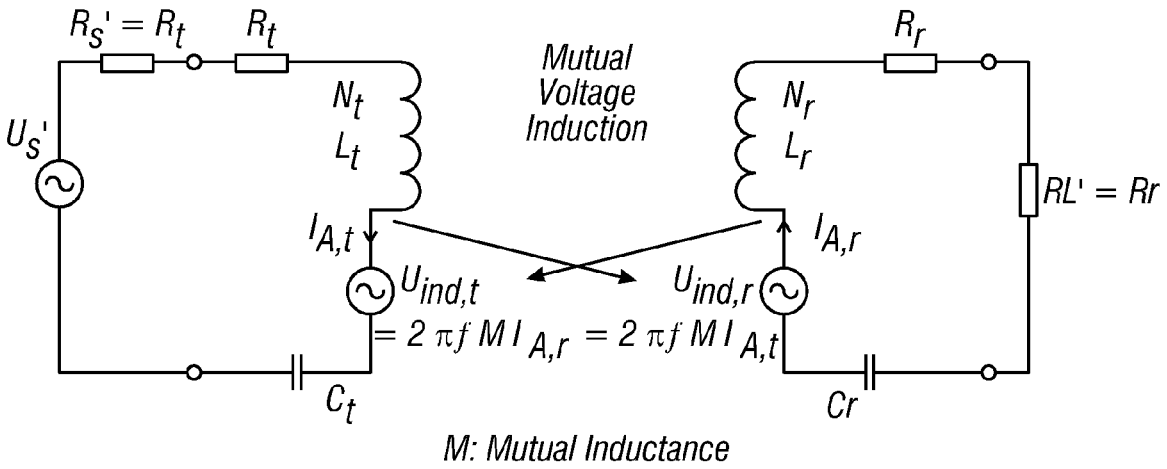
FIG. 4C shows an equivalent circuit of mutual inductance.

FIG. 4C shows how an equivalent circuit of mutual inductance can be formed, were the mutual voltage inductance may be offset against one another. For example, the current flows in the two sources can be made equivalent to one another according to their mutual inductance.

The transfer efficiency can be derived according to the equations:

Unloaded Q-factor of transmitter resonator antenna:

$$Q_t = \frac{1}{R_t}\sqrt{\frac{L_t}{C_t}} \tag{1}$$

Relation of input power to antenna coil current:

$$I_{A,t}^2 = Q_t \cdot \sqrt{\frac{C_t}{L_t}} \cdot P_t = \frac{P_t}{R_t} \tag{2}$$

Relation of antenna current to magnetic field in distance $d$:

$$H^2(d) = \frac{r_{A,t}^4 \cdot N_t^2 \cdot I_{A,t}^2}{4\underbrace{(r_{A,t}^2 + d^2)}_{d'(d)}^3} = \frac{r_{A,t}^4 \cdot N_t^2 \cdot I_{A,t}^2}{4d'^6(d)} \tag{3}$$

Voltage induced into receiver antenna coil:

$$U_{ind,r}^2(d) \cong (2\pi f)^2 \cdot N_r^2 \cdot \pi^2 \cdot r_{A,r}^4 \cdot \mu_0^2 \cdot H^2(d) \quad \text{(coaxialcase)} \tag{4}$$

Relation of induced voltage to output power into load:
(Receive antenna unloaded Q-factor)

$$P_r(d) = \frac{Q_r}{4} \cdot \sqrt{\frac{C_r}{L_r}} \cdot U_{ind}^2(d) \tag{5}$$

Efficiency (neglecting reverse induced voltage into transmit antenna):

$$\eta(d) = \frac{P_r(d)}{P_t} \cong (2\pi f)^2 \cdot N_r^2 \cdot \pi^2 \cdot r_{A,r}^4 \cdot \mu_0^2 \cdot \tag{6}$$

-continued $$\frac{r_{A,t}^4 N_t^2}{16 d'^6(d)} \cdot Q_t \sqrt{\frac{C_t}{L_t}} \cdot Q_r \cdot \sqrt{\frac{C_r}{L_r}}$$

(Unload Q-factors)

Further useful relations

Inductance of antenna coils:

$$L_t = \frac{\mu_0 \cdot N_t^2 \cdot r_{A,t}^2 \cdot \pi}{\kappa_t} \tag{7a}$$

$$L_r = \frac{\mu_0 \cdot N_r^2 \cdot r_{A,r}^2 \cdot \pi}{\kappa_r} \tag{7b}$$

Cell geometry terms

Series capacitance for resonance at frequency $f$:

$$C_t = \frac{1}{(2\pi f)^2 L_t} \tag{8a}$$

$$C_r = \frac{1}{(2\pi f)^2 L_r} \tag{8b}$$

Efficiency:

$$\eta(d) = \frac{P_r(d)}{P_t} \cong (2\pi f)^2 \cdot N_r^2 \cdot \pi^2 \cdot r_{A,r}^4 \cdot \mu_0^2 \cdot \frac{r_{A,t}^4 N_t^2}{16 d'^6(d)} \cdot Q_t \sqrt{\frac{C_t}{L_t}} \cdot Q_r \cdot \sqrt{\frac{C_r}{L_r}} \tag{9}$$

Efficiency (valid for small $\eta$ and for circular coaxial coil antennas):

$$\eta(d) \cong \frac{r_{A,t}^2 \cdot r_{A,r}^2 \cdot Q_t \cdot Q_r \cdot \kappa_r \cdot \kappa_t}{16 \left(r_{A,t}^2 + d^2\right)^3} \tag{10}$$

Near field condition:

$$d < \frac{\lambda}{2\pi}$$

(valid for circular co-axial coils)

$\kappa_t$, $\kappa_r$: Terms accounting for specific coil geometry $[\kappa] = m$ Three specific coil geometry forms are shown in FIGS. 5A-5C.

Figure 5A:
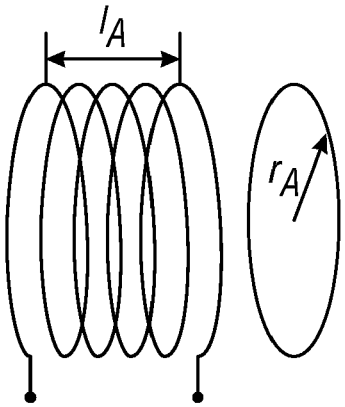
FIGS. 5A-5C show different solenoid geometries.
Figure 5B:
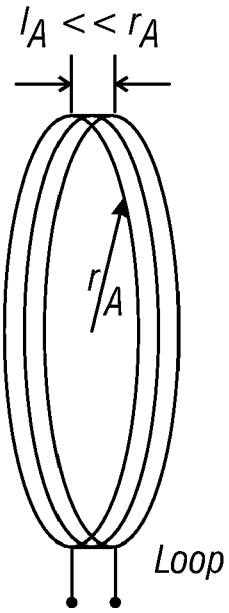
Figure 5C:
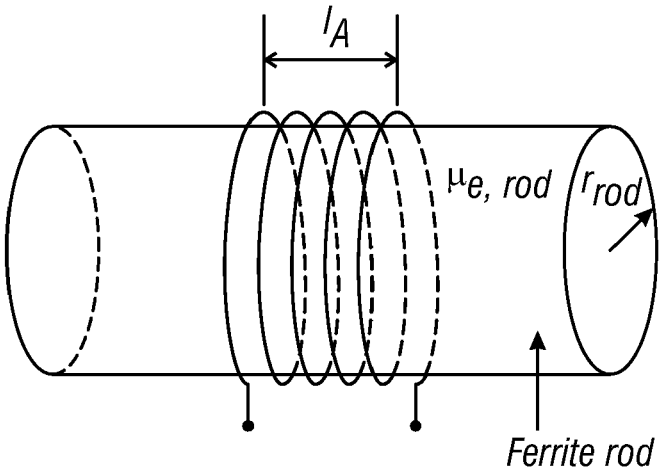

FIG. 5A shows an air solenoid, where the total thickness of the solenoid is of value $l_A$. FIG. 5B shows a loop, where the windings of the coil are very close together. In this loop, the value $l_A$ is much less than the radius $r_A$. Finally, FIG. 5C shows a ferrite rod antenna embodiment.

The coil characteristics are as follows:

Coil geometry terms (examples):

$$\kappa_{sol} = (0.9 \cdot r_A + l_A) \tag{11}$$

$$\kappa_{loop} = \frac{r_A \cdot \pi}{\ln\left(\frac{8 \cdot r_A}{b} - 2\right)} \tag{12}$$

Wire radius

-continued $$\kappa_{Fe_rod} = l_A\, r_{A,Fe_rod} = r_{rod} \sqrt{\mu_{e,rod}} \tag{13}$$

equivalent coil radius

Equivalent relative permeability of ferrite rod

The transfer efficiency can therefore be calculated as:

Near field condition:

$$\eta(d) \cong \frac{r_{A,t}^2 \cdot r_{A,r}^2 \cdot Q_t \cdot Q_r}{16 d^6} \text{ for } d \cong d' \tag{14}$$

$$d < \frac{\lambda}{2\pi}$$

So, given a Q-factor, efficiency is no longer a function of frequency.

Efficiency decreases with $d^6$.

Doubling transmitter coil radius increases range by sqrt (2)=(41%).

Doubling transmitter Q-factor doubles efficiency.

Doubling Q-factor increases distance only by sixth root of 2 (12%).

Magnetic field strength generated by transmitted using eq. (1), (2), (3):

$$H^2(d) = \frac{r_{A,t}^2\, Q_t \kappa_t}{(2\pi f) \cdot \mu_0 \pi \cdot 4 d'^6} \cdot P_t \tag{15}$$

Relation of magnetic field strength to received power:

$$P_r(d) = \frac{(2\pi f) \cdot \mu_0 \pi r_{A,r}^2 Q_r \kappa_r}{4} \cdot H^2(d) \tag{16}$$

$$\boxed{H^2(d) \sim \frac{1}{f} \cdot P_t}$$

$$\boxed{P_r(d) \sim f \cdot H^2(d)}$$

$$\boxed{\rightarrow \eta \sim \frac{P_r}{P_t} \neq f(f)}$$

Conclusion:

To transfer the same amount of power, the generated H-field strength increases proportionally to $\sqrt{1/f}$ with decreasing frequency E.g., at 135 kHz a 20 dB higher H-field strength is generated than at 13.5 MHz

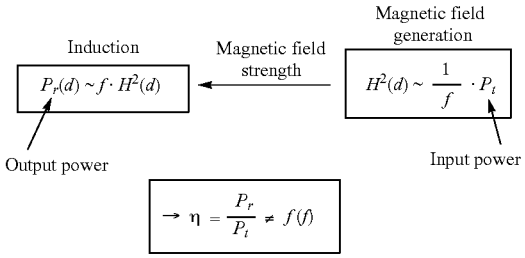

For given antenna geometries and Q-factors, transfer efficiency is frequency independent Conclusion:

To transfer the same amount of power, the generated H-field strength increases proportionally to $\sqrt{1/f}$ with decreasing frequency.

E.G. at 135 kHz a 20 dB higher H-field strength is generated than at 13.5 MHz

Induced voltage as function of distance:

Mutual inductance $$U_{ind,r}(d) \cong (2\pi f) \cdot M(d) \cdot I_{A,t} \tag{17}$$

Relation of antenna current to magnetic field strength:

$$H(d) = \frac{r_{A,t}^2 \cdot N_t \cdot I_{A,t}}{2\sqrt{\left(r_{A,t}^2 + d^2\right)^3}} \cong \frac{r_{A,t}^2 \cdot N_t \cdot I_{A,t}}{2d'^3(d)} \tag{18}$$

Relation of magnetic field strength to induced voltage:

$$U_{ind,r}(d) \cong (2\pi f)\mu_0 r_{A,r}^2 \pi N_R \cdot H(d) \cong (2\pi f)\left(\mu_0 r_{A,r}^2 \pi N_R \cdot \frac{r_{A,t}^2 \cdot N_t}{2d'^3(d)}\right) I_{A,t} \tag{19}$$

Mutual inductance:

$$M(d) \cong \frac{\mu_0 \pi r_{A,t}^2 r_{A,r}^2 N_r N_t}{2d'^3(d)} \tag{20}$$

Coupling factor (definition):

$$k(d) \cong \frac{M(d)}{\sqrt{L_t \cdot L_R}} \tag{21}$$

Using equations (20), (7a), and (7b):

$$k(d) \cong \frac{r_{A,t}\, r_{A,r} \cdot \sqrt{\kappa_r \kappa_t}}{2d'^3(d)} \tag{22}$$

-continued $$\eta(d) \cong \left(\frac{r_{A,t}^2 r_{A,r}^2 \cdot \kappa_r \kappa_{t\,r}}{16(d)'^6(d)}\right) \cdot Q_t Q_r \left(\frac{k(d)}{2}\right)^2 \tag{23}$$

$$\eta(d) \cong \left(\frac{k(d)}{2}\right)^2 \cdot Q_t Q_r \cong \frac{M^2(d)}{4L_t L_r} \cdot Q_t Q_r \tag{24}$$

Definition of mutual quality factor:

$$Q_{tr}(d) \cong \frac{(2\pi f) \cdot M(d)}{\sqrt{R_t R_r}} \tag{25}$$

$$\eta(d) \cong \frac{1}{4} Q_{tr}^2(d) \tag{26}$$

Based on these characteristics, the coupling factor can be considered primarily a function of geometric parameters and distance. The distance cannot be controlled, but of course the geometric parameters can be. The mutual inductance, overall loss resistances of the antennas and operating frequencies may also relate to the efficiency. Lower frequencies may require lower loss resistances or higher mutual inductance to get the same transfer efficiency as at higher frequencies.

Figure 6:
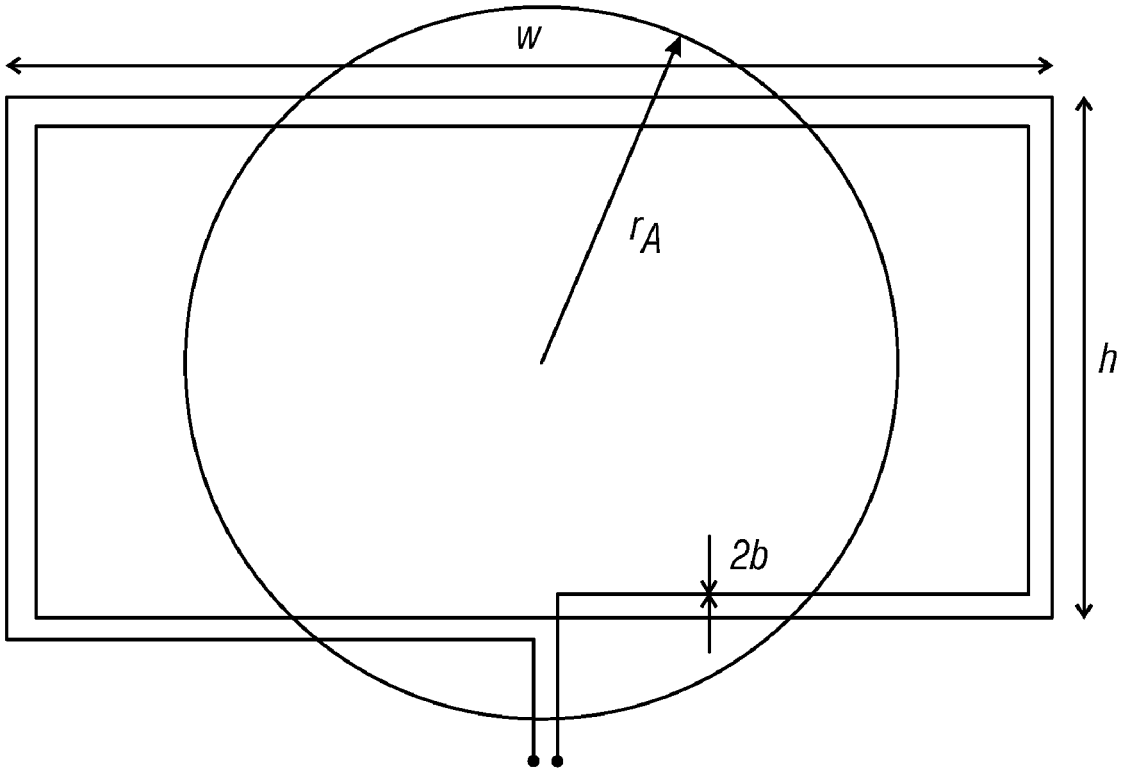
FIG. 6 shows a rectangular resonance loop.

The transfer efficiency for a rectangular loop is as follows, for the loop with characteristics shown in FIG. 6.

Geometry term (applicable to transmitter and receiver):

$$K_{rect} = \frac{w \cdot h \cdot \pi}{-2\left(w+h) + 2\sqrt{(h^2+w^2)}\right) - h \cdot \ln\left[\frac{h+\sqrt{(h^2+w^2)}}{w}\right] - w \cdot \ln\left[\frac{w+\sqrt{(h^2+w^2)}}{h}\right] + h \cdot \ln\left[\frac{2w}{b}\right] + w \cdot \ln\left[\frac{2h}{b}\right]} \quad (27)$$

Magnetic field strength generated by rectangular transmit loop:

$$H(d) = \frac{r_{A,t}^2 \cdot N_t \cdot I_{A,t}}{2d'^3(d)} \quad (28)$$

$$d'(d) = \left[\frac{2 \cdot \sqrt{\left(\frac{w_r}{2}\right)^2 + \left(\frac{h_r}{2}\right)^2 + d^2}}{\frac{1}{\left(\frac{w_t}{2}\right)^2 + d^2} + \frac{1}{\left(\frac{h_t}{2}\right)^2 + d^2}}\right]^{1/3} \quad (29)$$

Transfer efficiency:

$$\eta(d) \cong \frac{r_{A,t}^2 \cdot r_{A,t}^2 \cdot Q_t \cdot Q_r \cdot \kappa_r \cdot \kappa_t}{16 \cdot d'^6(d)}$$

Equivalent radii:

$$r_{A,t} = \sqrt{\frac{w_t \cdot h_t}{\pi}} \quad (30)$$

$$r_{A,r} = \sqrt{\frac{w_r \cdot h_r}{\pi}} \quad (31)$$

$$r_{A,r} = \sqrt{\frac{w_r \cdot h_r}{\pi}} \quad (32)$$

(32)

Optimization of the number of turns can be considered as follows:

$$Q_{coil}(N) = \frac{2\pi f \cdot L(N)}{R_{loss}(N) + R_{rad}(N)} \cong \frac{2\pi f \cdot L(N)}{R_{loss}(N)}; \; R_{loss} >> R_{rad}$$

For large enough $N$:

$$L(N) = \frac{\mu_0 N^2 \pi (r_A - b(N))^2}{0.9(r_A - b(N)) + l_A} \quad (34)$$

Adapted to fit into form factor

Wire radius: $b(N) = \frac{l_A}{4N}$

-continued $$R_{loss}(N) = \frac{N \cdot 2\pi(r_A - b(N))(\alpha(\theta, N) + 1)}{\sigma \cdot 2\pi\, b(N) \cdot \delta} \quad (35)$$

Proximity effect: $\alpha = f(\theta, N)$

Skin depth: $\delta = \frac{1}{\sqrt{\sigma \pi f \mu_0}}$

Numerical example: $r_A = \frac{l_A}{2}$;

$$Q_{coil} \sim \frac{(2N-1)}{(5.8N-0.9)} \neq f(N) \quad \theta = \text{const} \quad (36)$$

For large enough N for a coil of length lA, radius $r_A$, and pitch to wire diameter ratio of θ=2c/2b.

If resonance frequency is used as the optimization parameter, then $$Q_{coil}(f) = \frac{2\pi f \cdot L}{R_{loss}(f) + R_{rad}(f)}; \text{ (Inductance is kept constant)} \quad (37)$$

$$R_{loss}(f) \sim \sqrt{f} \text{ (skin effect)} \quad (38)$$

$$R_{rad}(f) = 320\pi^4\left(\frac{\pi r_A^2}{\lambda^2}\right)^2 N^2 \sim f^4 \quad (39)$$

At low frequency (Skin effect predominant):

$$Q_{coil} \sim \sqrt{f} \quad (40)$$

At high frequency (Radiation resistance predominant):

$$Q_{coil} \sim \frac{\sqrt{f}}{f^4} \quad (41)$$

Figure 7A:
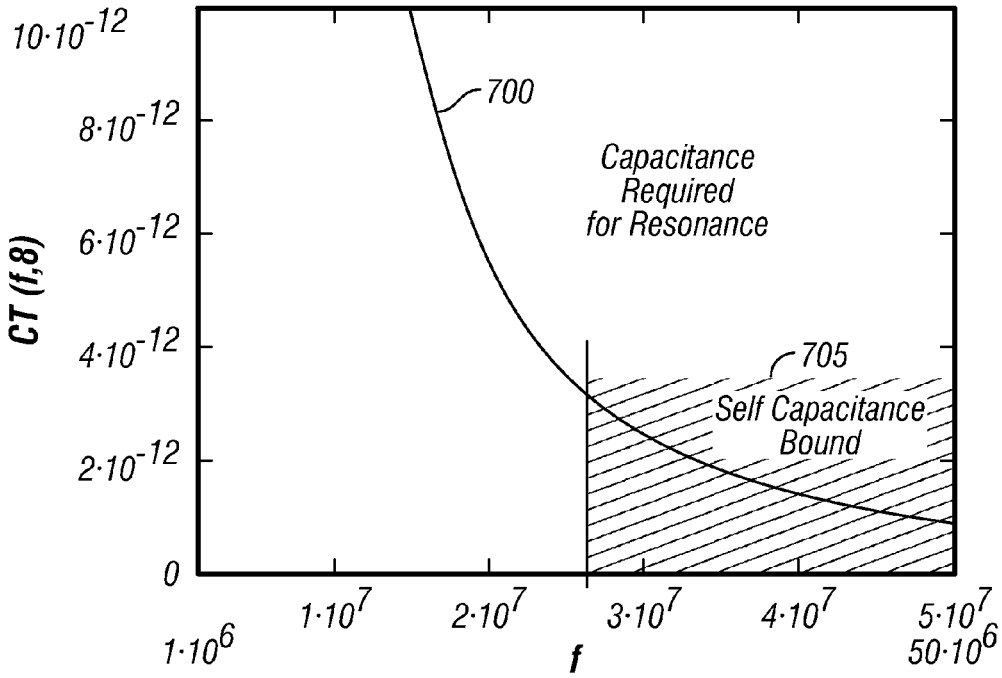
FIGS. 7A and 7B show a cute factor operation.
Figure 7B:
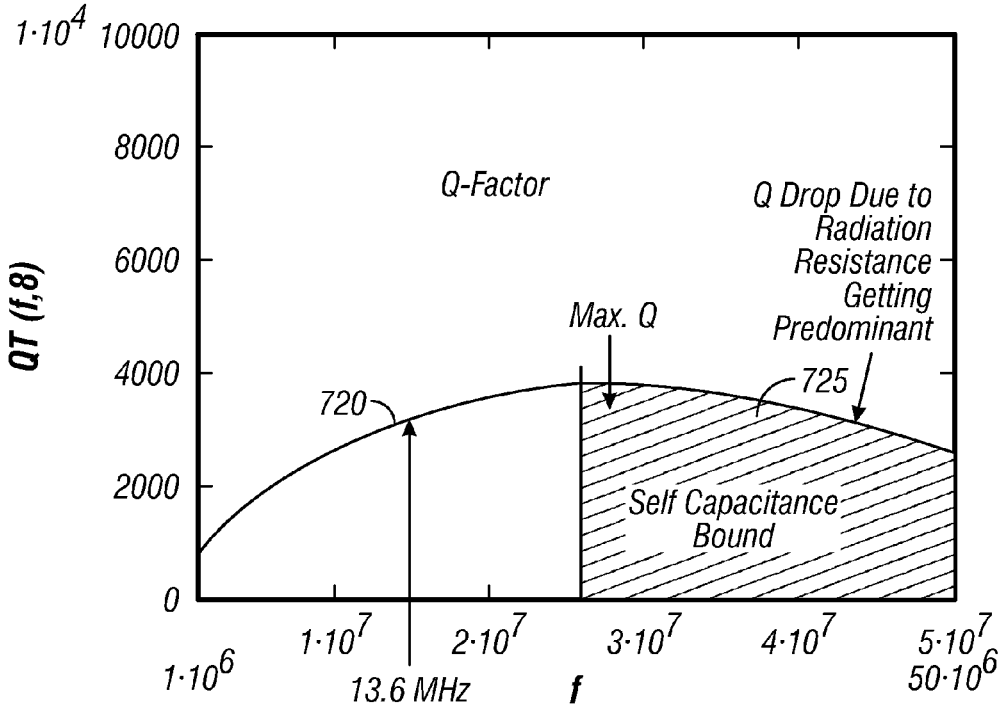

FIGS. 7A and 7B show some specific numerical examples. For coil radius $r_A$ 8.5 cm; coil length la of 8 cm, wire diameter of 6 mm, number of turns N of 8, and wire conductivity of copper $58\times10^6$. FIG. 7A shows the capacitance needed for resonance 700, and shows the self capacitance bound 705. FIG. 7B shows the Q factor 720 at 13.56 MHz; again showing the self capacitance bound 725.

From these equations, we can draw the conclusion that for given coil form factor the Q factor is independent to some extent of the number of turns. Coils formed of thicker wires and less windings may perform as well as coils with a higher number of turns. However, the Q factor is highly dependent on the frequency. At low frequencies the Q factor increases according to $f^{1/2}$. This is dependent primarily on the skin effect. At higher frequencies, the key factor increases as $f^{-7/2}$. This is dependent on the skin effect plus the radiation resistance.

There exists an optimum frequency where the Q is maximized. For any given coil this depends on the coil's form factor. The maximum Q, however, almost always occurs above the self resonance for frequency of the coil. Near self resonance, the coil resonator is extremely sensitive to its surroundings.

Figure 8:
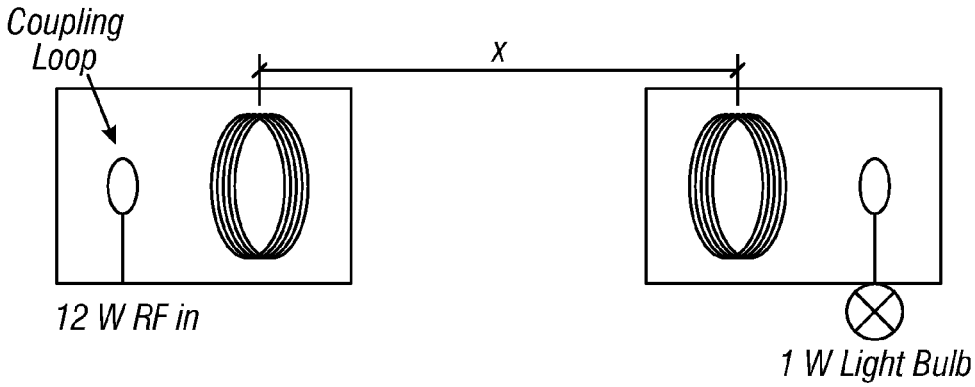
FIG. 8 shows a coupling loop.

FIG. 8 illustrates an experiment conducted to find values which maximize the results. This uses a coil with the following characteristics Coil Characteristics:

Radius: $r_{A,t}=r_{A,r}=8.5$ cm

Length: $l_{A,t}=l_{A,r}=20$ cm

Wire diameter: $2b_{At}=2b_{Ar}=6$ mm

Number of turns: $N_t=N_r=7$

Coil material: Silver plated copper

Theoretical Q-factors: $Q_{theor}\cong2780$

Measured Q-factors: $Q_{meas}\cong1300$

Figure 9:
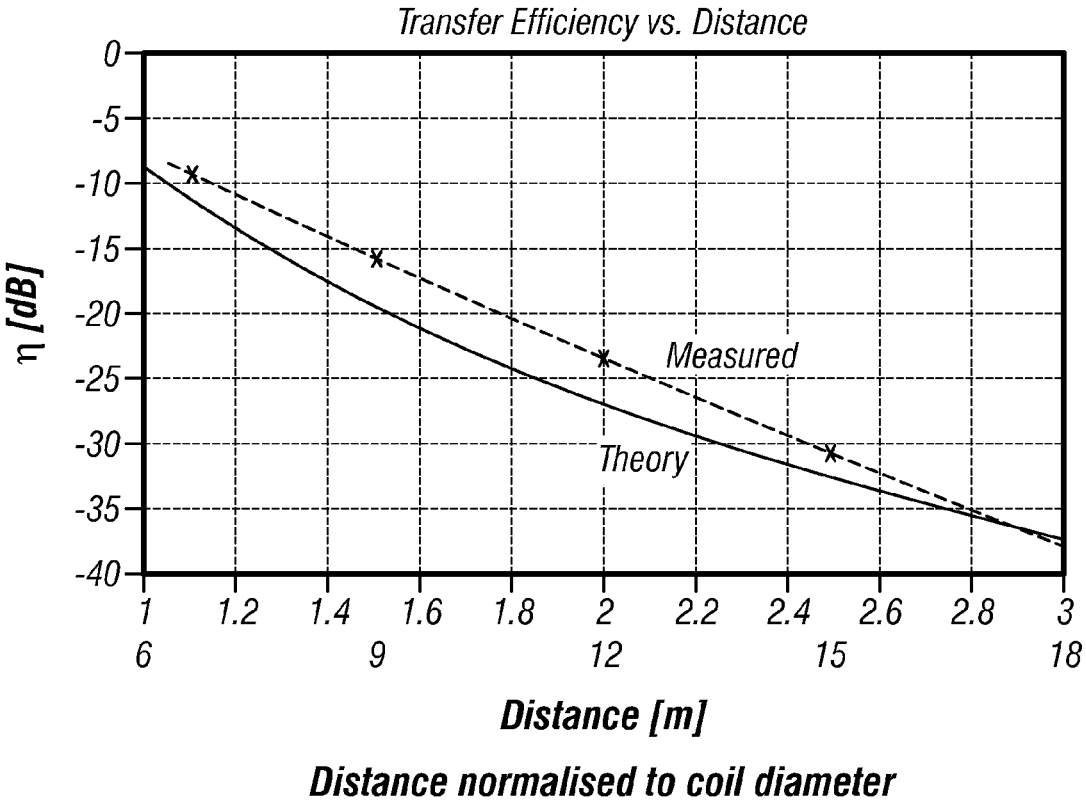
FIG. 9 shows a graph of power transfer versus distance.

This produced a result shown in FIG. 9, over distance, showing an efficiency slightly higher than calculated.

Figure 10A:
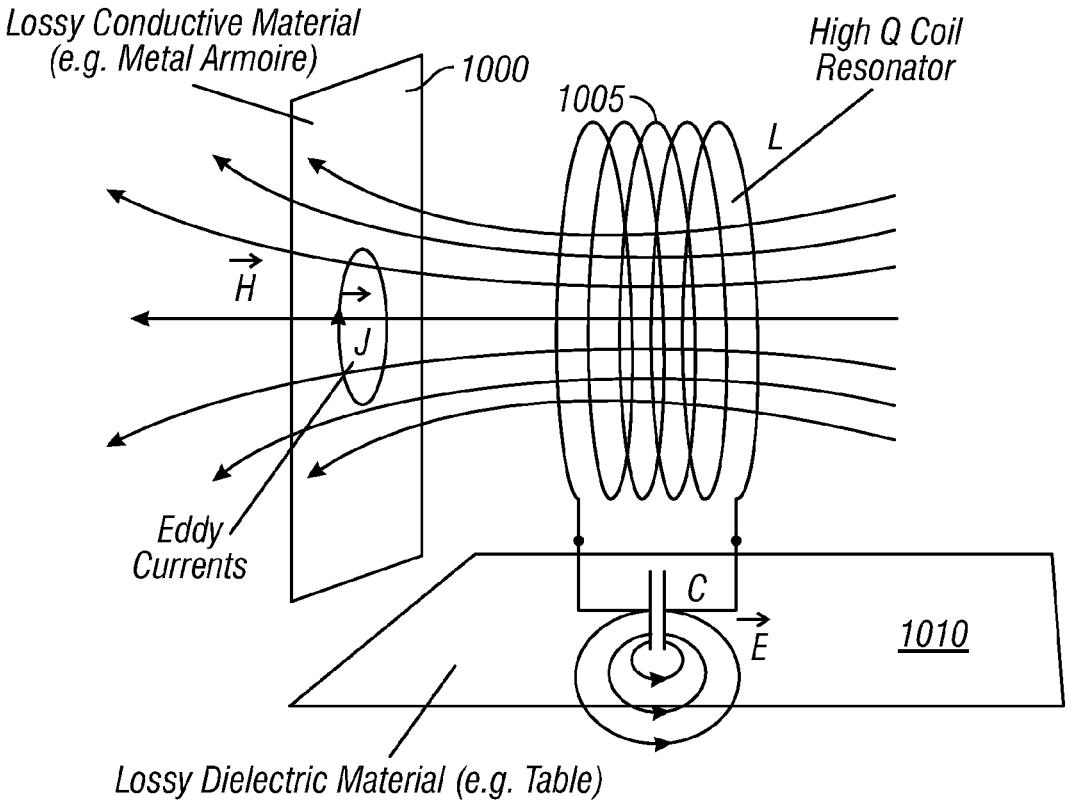
FIGS. 10A and 10B show the effect of a lossy environment on high resonators.
Figure 10B:
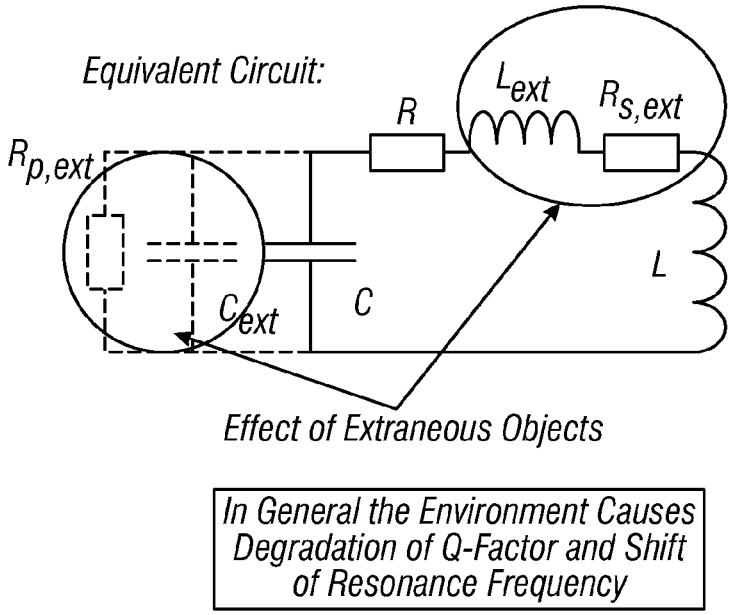

The magnetic power transmission according to this disclosure may rely on high-Q for improved efficiency. A lossy environment can have a deleterious effect on high Q resonators. Using the antenna 1005 near a lossy material such as a dielectric material 1010 such as a table or a conductive material such as a metal part 1000 is shown in FIG. 10A. The extra parts create extraneous objects modeled in the equivalent circuit of FIG. 10B. In general, these will change the self resonance frequency and shift or degrade the Q factor unless compensated. In one embodiment, a tuning element such as any of the different tuning elements described herein, may also be included which can compensate the effect of the extraneous objects on Q of the antenna.

In order to reduce the effects of the environment, various measures can be taken. First, consider the Q factor Q-factor:

$$Q = \frac{1}{R}\sqrt{\frac{L}{C}}$$

Resonance frequency:

$$f_{res} = \frac{1}{2\pi\sqrt{LC}}$$

This is three variables and two equations, leaving 1 degree of freedom for the resonator design.

Resonators with low inductance to capacitance ratios tend to be more stable in an environment where dielectric losses are predominant. Conversely, high inductance to capacitance ratio resonators tend to be more stable in environments where eddy current losses are predominant. Most of the time, the dielectric losses are predominant, and hence most of the time it is good to have a low L/C ratio.

Figure 11A:
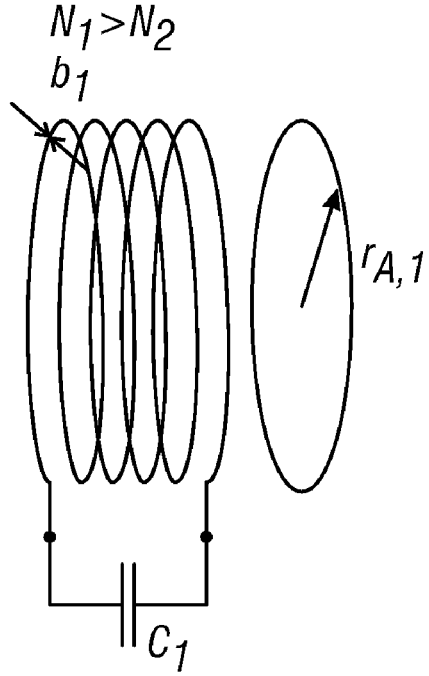
FIGS. 11A, 11B, 11C and 11D show the differences between high inductance to capacitance ratio resonant circuits and low inductance to capacitance ratio resonant circuit.
Figure 11B:
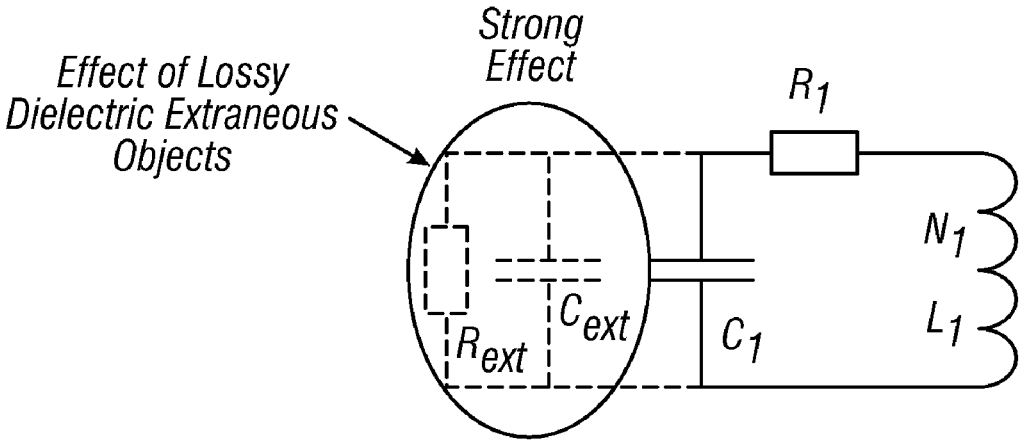

FIG. 11A shows a resonator whose equivalent circuit for a high L/C ratio resonant circuit is shown in FIG. 11B. This resonator can be described as:

$$f_{res} = \frac{1}{2\pi\sqrt{L_1C_1}} =$$

$$Q = \frac{1}{R_1}\sqrt{\frac{L_1}{C_1}} =$$

high low

Note that there is a strong effect from lossy dielectrics.

Figure 11C:
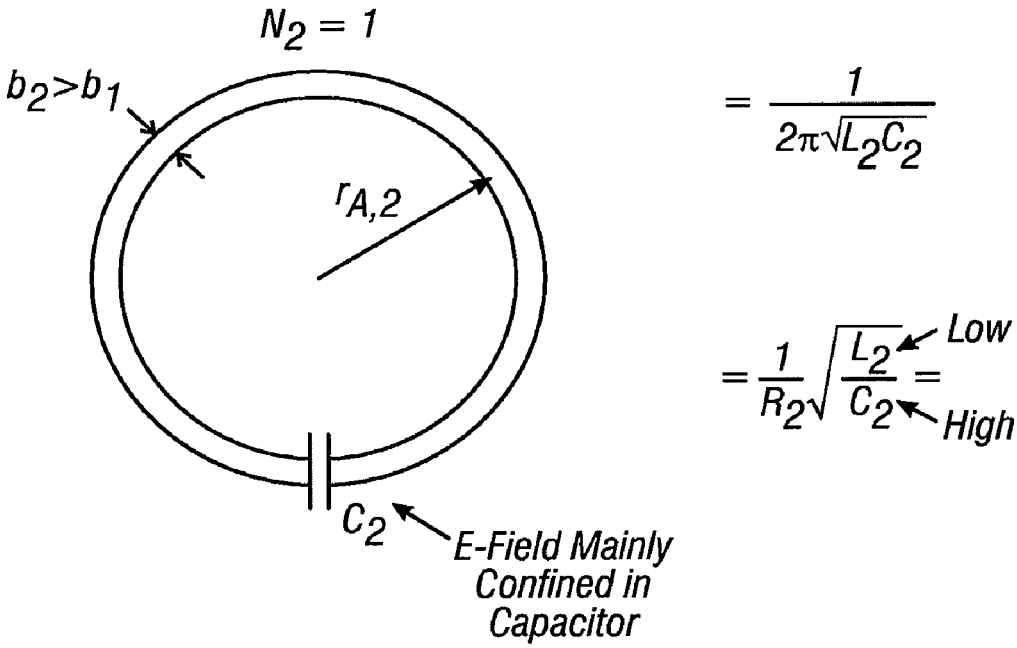
Figure 11D:
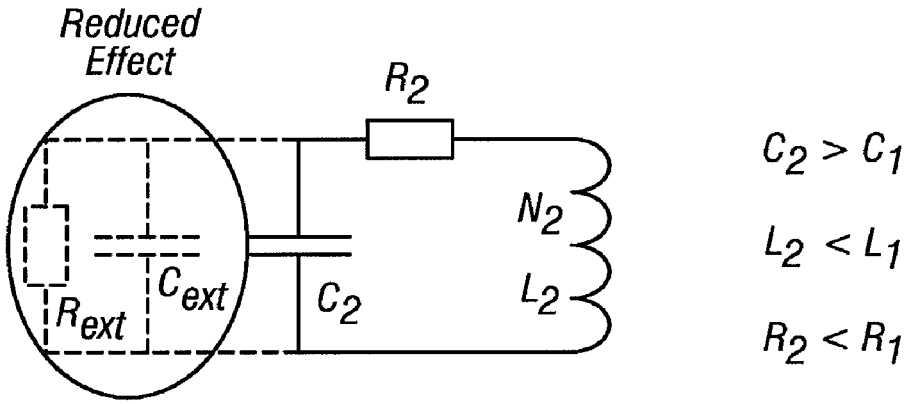

FIG. 11C shows a loop resonator with a low number of turns, hence low L/C ratio. FIG. 11D shows that there is a reduced effect from the dielectric.

$$= \frac{1}{2\pi\sqrt{L_2C_2}}$$

$$= \frac{1}{R_2}\sqrt{\frac{L_2}{C_2}} =$$

low high

Exemplary resonators for environments with lossy dielectrics may operate at 13.56 MHz and include a coupling loop that uses a seven turn, 6 mm silver plated copper wire with a 17 cm coil diameter and an air capacitor of 10 pF. Conversely, a low L/C ratio resonator for this frequency can operate without a coupling loop, using a 3 cm silver plated copper tube, 40 cm diameter loop and high-voltage vacuum capacitor of 200 pf.

For the low L/C resonant antennas, a vacuum capacitor may produce significant advantages. These might be available in capacitance values of several nanofarads, and provide Q values greater than 5000 with very low series resistance. Moreover, these capacitors can sustain RF voltages up to several kilovolts and RF currents up to 100 A.

To conclude from the above, high L/C ratio resonator antennas e.g. multi-turn loops are more sensitive to lossy dielectrics. Low L/C ratio resonator antennas e.g. single turn loops are more sensitive to a lossy conductive or ferromagnetic environment. Q factors of the described antennas, however, may vary between 1500-2600. A single turn transmit loop of 40 cm in diameter may have a Q value larger than 2000. In one embodiment a method includes determining if an environment will have dielectric losses or Eddy current losses. The method further includes selecting a resonator with high inductance to capacitance ratio resonator for an environment where eddy current losses are predominant based on the determining. The method further includes selecting a low inductance to capacitance ratio resonator for an environment where dielectric losses are predominant based on the determining. The method further includes using said selected resonator as part of a system to retrieve electrical power from a magnetic power transmission.

Figure 12A:
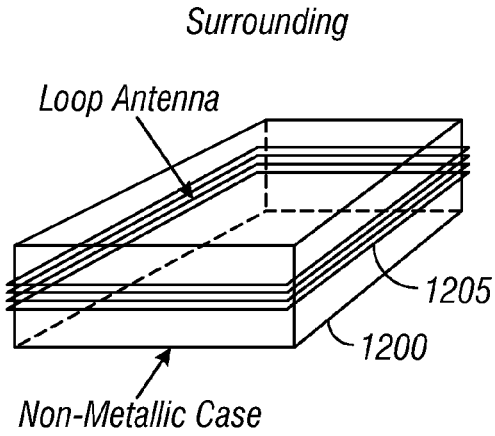
FIGS. 12A, 12B, and 12C illustrate the integration of wireless power into a portable device.
Figure 12B:
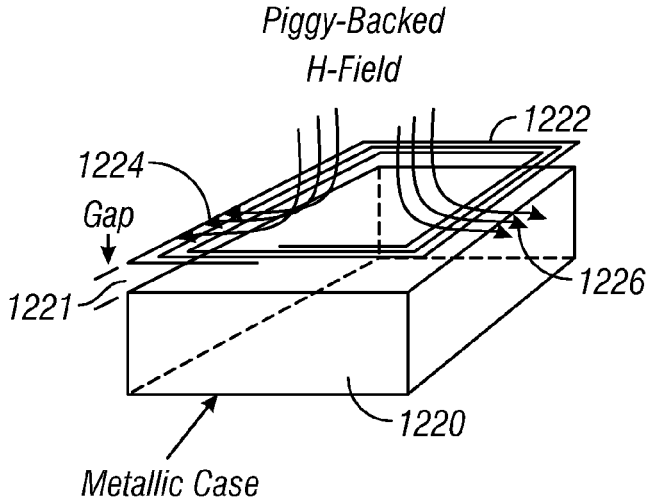
Figure 12C:
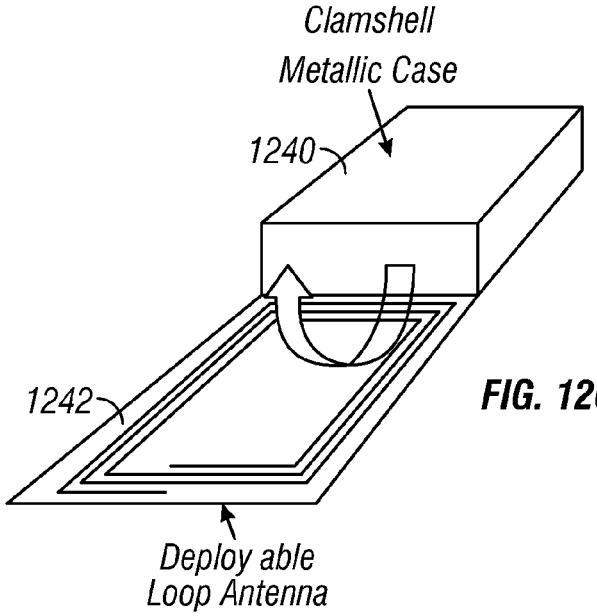

The wireless power may be integrated into portable devices and a number of different ways as shown in FIGS. 12A-12C. FIG. 12A shows that a non-electrically conductive housing 1200 may have a loop antenna 1205 surrounding the perimeter of the case and touching that perimeter. The housing may have an opening that allows inserting and removing the battery without disturbing the antenna. FIG. 12B shows a metallic case 1220 in which there is a piggybacked insulator 1222 separated from the case itself by a gap 1221. The antenna coil 1224 is formed on the insulator 1222. The magnetic field 1226 created by the antenna passes through that gap 1221, in order to escape.

FIG. 12C shows how a metallic case 1240 may also use a clamshell with a deployable loop antenna 1242 that rotates, slides or folds away from the case.

Figure 13A:
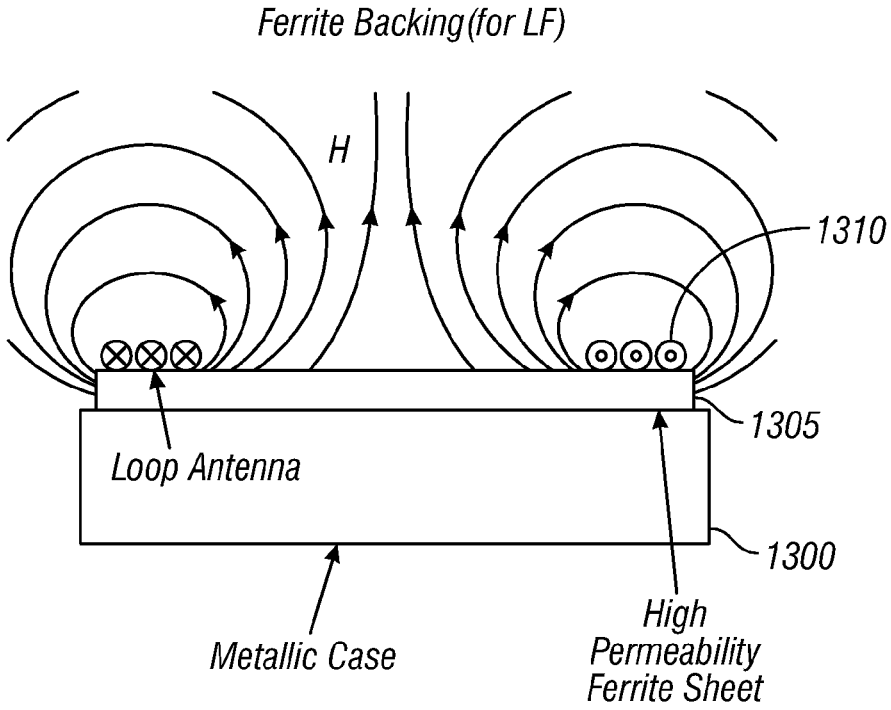
Figure 13B:
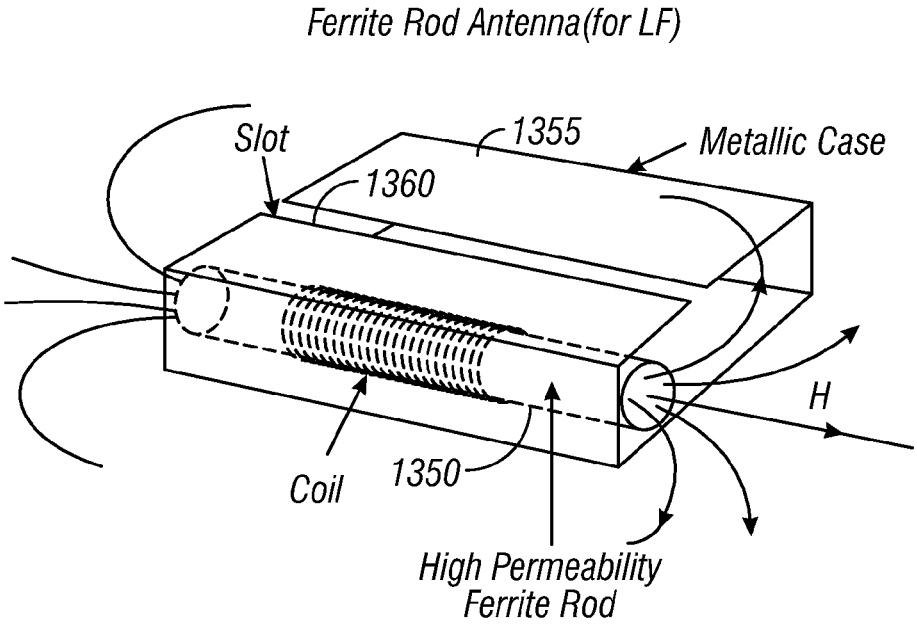

FIGS. 13A and 13B show multi-turn loop antennas integrated into a case in a way that minimizes eddy current effects. A metallic case 1300 as shown in FIG. 13A may be covered with a high permeability ferrite sheet 1305. A loop antenna 1310 can be formed directly on the ferrite sheet 1305, as shown in cross section in FIG. 13A. This may be more effective at low frequencies where ferrite materials produce significant advantages.

FIG. 13B shows using a high permeability ferrite rod 1350 within the metallic case 1355, and a coil wound around that ferrite rod. An open slot or slotted area 1360 may provide the area through which magnetic field H is received.

Given a specified magnetic field strength at a specified receiver position, at an operating frequency, receive power may be expressed as:

$$P_r \sim \frac{N^2 r_{A,e}^4}{R_{tot}(N, \sigma, r_A, A_w, \ldots)}$$

where:

$r_{A,e}$: Equivalent antenna coil radius (For air coils: $r_{A,e}=r_A$)

N: Number of turns of the wire loop antenna $R_{tot}$: Resonance resistance of L-C circuit that is a function of $r_A$: Physical radius of the wire loop antenna σ: Conductivity of wire material $A_w$ Cross-sectional area of the coil winding Note according to this equation, that the value of N, the number of turns, appears both in the numerator and denominator, (appearing as a squared term in the numerator)

The power is also inversely proportional to Aw; the cross-sectional area of the winding. Increasing the cross-sectional area may improve power yield. However, this may become too heavy and bulky for practical integration.

The value σ represents the electrical conductivity of the wire material. Increasing this may increase the power yield proportional to $\sigma^k$, with the exponent k in the range of 0.5 to 1. Copper and silver are the best conductors, with silver being much more expensive than copper. Room temperature superconductivity could improve this value.

The value $r_A$ represents the physical or equivalent radius. However, this physical radius is limited by the form factor of the device into which the antenna will be integrated. The equivalent radius of a wire loop of this type may be increased through use of materials or devices that locally increase alternating magnetic flux to generate electromotive force in the wire loop. Increasing this equivalent radius may be a very effective antenna parameter, since the received power is proportional to this radius to the fourth power. Moreover, increasing the equivalent radius also increases the Q factor by $r^2$. This produces a double benefit.

$$P_r \sim \frac{N^2 r_{A,e}^4}{R_{tot}(N, \sigma, r_A, A_w, \ldots)} \sim r_{A,e}^2 Q(N\, r_{A,e} R_{tot})\, \kappa$$

$$Q \sim \frac{N^2 r_{A,e}^2}{\kappa \cdot R_{tot}(N, \sigma, r_A, A_w, \ldots)}$$

κ: Geometry term accounting for the specific form factor of the antenna (e.g. coil length, wire diameter)

An embodiment discloses increasing the equivalent radius of a wire loop antenna without increasing its actual radius. A first technique uses materials with ferromagnetic properties such as ferrites. It is also possible to exploit the gyromagnetic effect of ferrites. In addition, magneto MEMS systems can be used for this. Each of these techniques will be separately discussed.

Materials that have ferromagnetic properties (susceptibility $\chi_m$ greater than zero) can magnify magnetic flux density inside a coil.

$$B=\mu_0(1+\chi_m)H=\mu_0(H+M)=\mu_0\mu_r H$$

M is the magnetization of the material, and $u_r$ is the relative permeability of the material. The ferromagnetic material in essence adds additional magnetic flux to the already existing flux. This additional flux originates from the microscopic magnets or magnetic dipoles that are inside the material.

The magnetic dipole moment results from electron spin and orbital angular momentum in atoms. The moment mostly comes from atoms that have partially filled electron shells and unimpaired/non-compensated spins. These atoms may exhibit a useful magnetic dipole moment.

Figure 14:
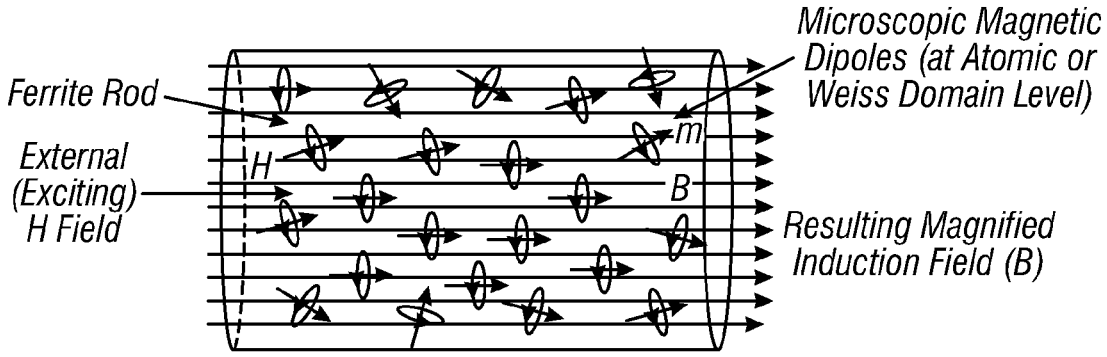
FIG. 14 shows the magnetic field and dipole moments within a ferrite rod.

When an external magnetic field is applied, magnetic dipoles organized in lattice domains align with the external field. See FIG. 14. Higher applied magnetic fields cause more Weiss domains to be aligned with the magnetic field. Once all those domains are fully aligned, the resulting magnetic flux cannot further increase. This alignment is called saturated.

Ferrite materials typically show a hysteresis effect between the applied magnetic field or H field and the resulting B field. The B field lags behind the H field. In an induction coil wound around the ferrite rod, this effect causes a non-90 degree phase shift between the AC current and the AC voltage against the inductor. At low-H field strength, the hysteresis effect is reduced, thereby reducing losses.

The flux magnification effect of the ferrite rod depends on both the relative permeability ($\mu_r$) of the ferrite material used, and on the form factor of the rod, for example the diameter to length ratio. The effect of the ferrite rod and a coil antenna may be described by an equivalent relative permeability $\mu_e$ which is typically much smaller than $\mu_r$. For an infinite diameter and length ratio $\mu_e$ approaches $\mu_r$. The effect of the Ferrite rod is equivalent to an increase of antenna coil radius by $\sqrt{\mu_e}$. At frequencies below 1 MHz and a ratio $2r_A/l_A=0.1$ the increase of the equivalent radius by the Ferrite will be in the order of 3 to 4. Nevertheless, depending on physical size constraints, the use of a Ferrite rod may be beneficial considering that power yield increases according to $r_{A,e}^4$ (i.e., the fourth power of the equivalent radius of the antenna).

Figure 15:
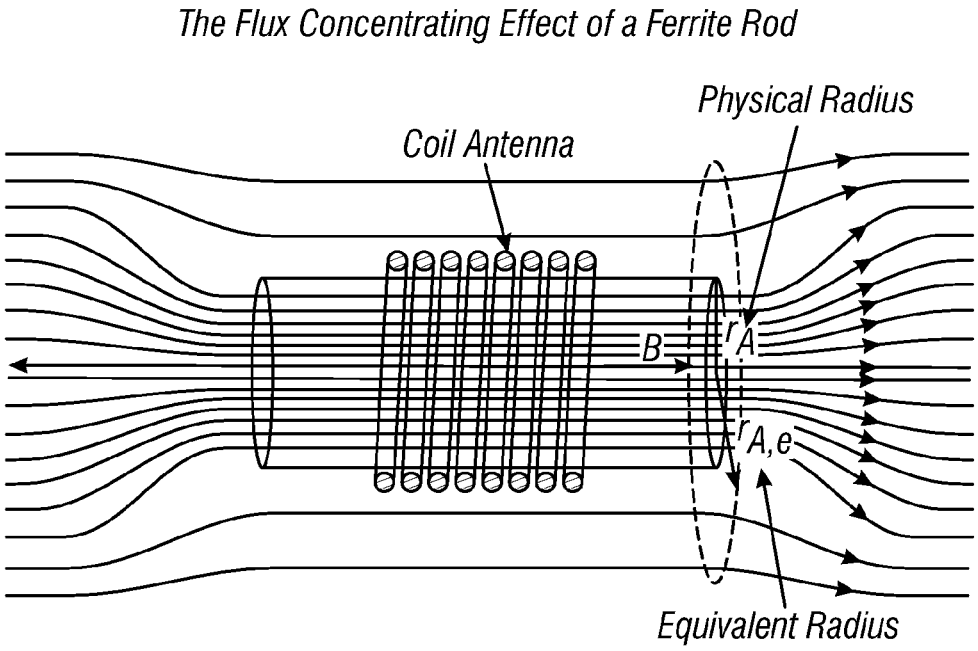
FIG. 15 illustrates flux concentrating effect of a ferrite rod.

FIG. 15 illustrates how a ferrite rod can increase the physical radius $r_A$ to an equivalent radius $r_{A,e}$ which is larger than the physical radius. In essence, the use of ferrite in a wire loop antenna causes magnification of the magnetic flux B by a factor $\mu_e$ which is equivalent to an increase of the coil radius by a factor of sqrt($\mu_e$).

The ferrite may need to be relatively long to increase the $\mu_e$ unless the coil radius is small. Ferrite antennas concentrate the magnetic flux inside the rod, which may also lower the sensitivity to the environment.

The Gyro magnetic effects of certain materials such as ferrite can also be used to increase the magnetic flux. When a static magnetic field is applied to a ferromagnetic material such that it saturates, the atomic magnetic dipole movement performs precession around the axis defined by the direction of the static magnetic field. This has an angular frequency of $$\omega_0=\gamma\mu_0 H_0$$

where with $$\gamma=-\frac{m}{J}$$

the gyromagnetic ratio m: the magnitude of the magnetic dipole moment

J: the magnitude of the angular momentum

Figure 16:
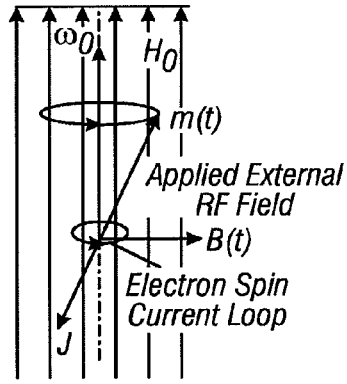
FIG. 16 shows how to exploit the gyro magnetic affect of ferrite antennas.

FIG. 16 illustrates the current loop and the fields. The alternating magnetic field is applied to a material and can cause an electron current spin loop.

Its relative permeability can be described as a complex tensor $$\mu_r=\mu_r'+j\mu_r''$$

which shows a resonance at $\omega_0$. This gyromagnetic resonance effect can form resonators with very high Q factors as high as 10,000.

Properties that are similar to these Gyro magnetic materials can be reproduced with magnetomechanical systems formed using MEMS. These systems may have the potential to imitate the gyromagnetic high Q resonance effect at lower frequency. Two different types of MEMS devices can be used: a compass type MEMS and a torsion type MEMS. The compass type MEMS uses a medium that is formed of micromagnets that are saturated by applying a static magnetic field $H_0$. The system exhibits resonance at the characteristic frequency defined by the magnetization and be inertial moment of the micro-magnets.

Similarly, a torsion type MEMS is formed of micromagnets that can move along a torsion beam. The system exhibits ferromagnetic resonance based on the magnetization and inertial moment as well as the spring constant.

Figure 17:
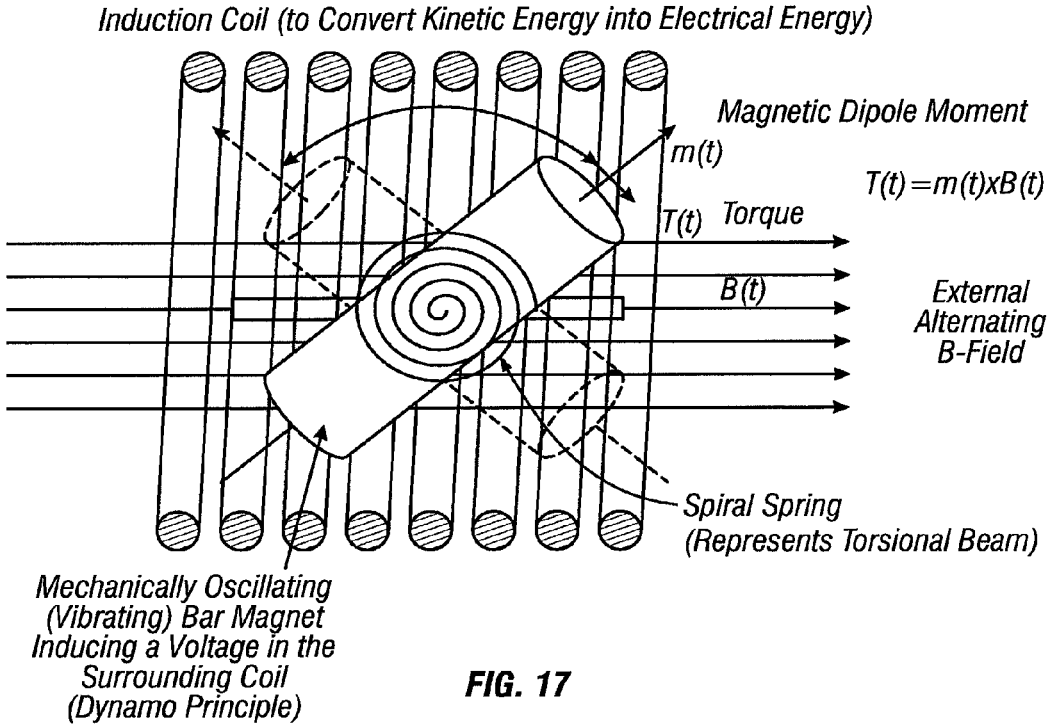
FIG. 17 illustrates the basic principle of a torsion type magneto mechanical systems.

FIG. 17 illustrates the basic principle of a torsion type Magneto-Mechanical System. In the context of power transmission, these MEMS devices may operate as a ferrite that amplifies the magnetic flux, a high Q. resonator, and/or a dynamo that is remotely driven by the transmitter. The dynamo receiver might convert electric energy to magnetic energy to kinetic energy back to electric energy at a remote location.

While the drawing shows mechano magneto oscillators that are bar-shaped, an embodiment may use disk or sphere shaped materials to improve their movability.

Figure 18:
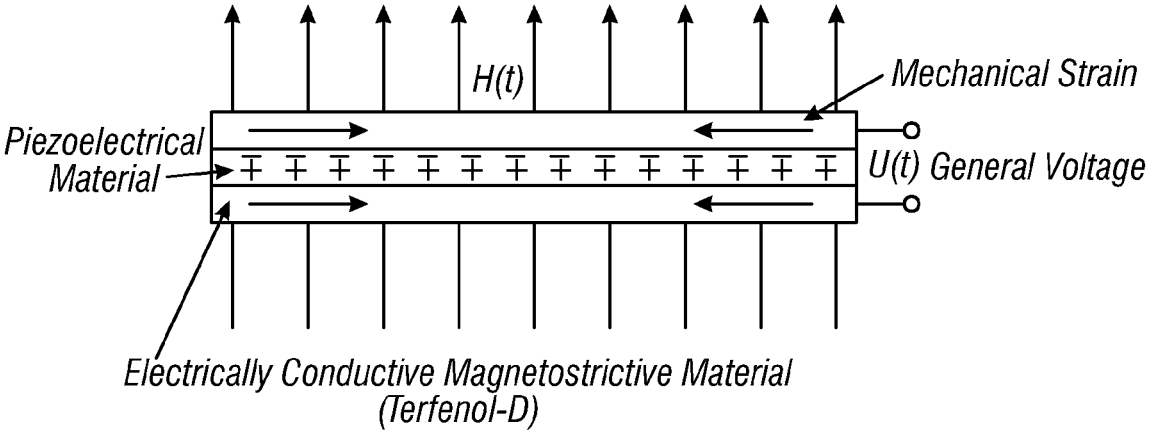
FIG. 18 illustrates how to use a magneto restrictive and piezoelectric device in order to generate electrical power from a low magnetic field.

Another possible way of transforming magnetic energy into electrical energy is combined magnetoscriction and piezoelectricity, which can be thought of as reverse electrostriction. FIG. 18 shows using a magnetostrictive and piezoelectric material to generate electrical power from a low magnetic field. Magnetostriction is the changing of the material shape when the material is subjected to a magnetic field. This shape change can occur when the boundaries of Weiss domains within a material migrate or when the domains rotate through external field. Cobalt and Terfenol-D have very high magnetostrictions. The relation between the strain and applied magnetic field strength becomes nonlinear.

A ribbon of magnetostrictive material with a length of a few centimeters shows a resonance that is similar to piezo crystals and quartz in the low-frequency range e.g. around 100 kHz. This effect is also used in passive RFID systems to cause a resonance that can be detected by the RFID coil.

Although only a few embodiments have been disclosed in detail above, other embodiments are possible and the inventors intend these to be encompassed within this specification. The specification describes specific examples to accomplish more general goal that may be accomplished in another way. This disclosure is intended to be exemplary, and the claims are intended to cover any modification or alternative which might be predictable to a person having ordinary skill in the art. For example, other sizes, materials and connections can be used. Although the coupling part of the antenna in some embodiments is shown as a single loop of wire, it should be understood that this coupling part can have multiple wire loops. Other embodiments may use similar principles of the embodiments and are equally applicable to primarily electrostatic and/or electrodynamic field coupling as well. In general, an electric field can be used in place of the magnetic field, as the primary coupling mechanism. While MEMS is described in embodiments, more generally, any structure that can create small features could be used.

Any of the embodiments disclosed herein are usable with any other embodiment. For example, the antenna formation embodiments of FIGS. 12A-12C can be used with the flux magnification embodiments.

Also, the inventors intend that only those claims which use the-words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

What is claimed is:

1. A system for receiving magnetic transmission of power, comprising:

an antenna circuit comprising a wire loop antenna, the wire loop antenna comprising a wire formed into at least one loop, the antenna circuit having an inductance and a capacitance with an L/C value tuned for receiving the power from a magnetic field of a first frequency, the antenna circuit configured to produce an output that includes electrical power based on receiving the power from the magnetic field; and a first electrical part configured to increase an equivalent radius of the wire loop antenna without increasing a physical radius of the wire loop antenna.

2. The system of claim 1, wherein the at least one loop comprises a rectangular loop.

3. The system of claim 2, wherein the rectangular loop has rounded corners.

4. The system of claim 1, wherein the first electrical part is configured to increase the magnetic field such that the wire loop antenna operates as if the equivalent radius of the wire loop antenna is greater than the physical radius of the wire loop antenna.

5. The system of claim 1, wherein at least a portion of the first electrical part comprises a ferrite material.

6. The system of claim 1, wherein at least a portion of the first electrical part comprises a material that increases magnetic flux in the system.

7. The system of claim 1, wherein the first electrical part comprises a flux magnification part.

8. The system of claim 7, wherein the flux magnification part comprises a rod, wherein an amount of flux magnification is related to a length of the rod.

9. The system of claim 8, further comprising a housing, wherein the rod is positioned within the housing, and wherein the at least one loop of the wire loop antenna is wound around the rod.

10. The system of claim 9, further comprising at least one opening in the housing allowing the magnetic field to pass through the opening and to interact with the rod.

11. The system of claim 10, wherein the rod comprises a ferrite material.

12. The system of claim 9, further comprising a slot in the housing.

13. The system of claim 12, wherein the housing comprises a conductive material.

14. The system of claim 7, further comprising a housing, wherein the wire loop antenna is placed along at least a portion of a surface of the housing.

15. The system of claim 14, wherein the portion of the surface of the housing comprises a perimeter of the housing.

16. The system of claim 14, wherein the housing comprises a metallic material, and wherein the wire loop antenna is separated from the metallic material.

17. The system of claim 16, wherein a gap is formed between the wire loop antenna and the metallic material, the gap being of a size through which the magnetic field can pass through.

18. The system of claim 16, further comprising a ferrite portion coupled to the housing and configured to hold at least a part of the wire loop antenna separated from the housing.

19. The system of claim 14, wherein the wire loop antenna is separable from the housing and movable relative thereto.

20. The system of claim 1, further comprising a connection to a wireless power circuit configured to power a load using the output.

21. A method for receiving a magnetic transmission of power, comprising:

receiving power using an antenna circuit comprising a wire loop antenna, the antenna circuit having an inductance L and a capacitance C with an L/C ratio tuned to a value that is resonant with a frequency of a magnetic field, the wire loop antenna having an equivalent radius that is greater than a physical radius of the wire loop antenna, wherein a first electrical part is used to provide the equivalent radius; and powering a load using the received power.

22. The method of claim 21, wherein the wire loop antenna comprises a rectangular loop.

23. The method of claim 22, wherein the rectangular loop has rounded edges.

24. The method of claim 21, wherein the first electrical part is configured to increase magnetic flux of the magnetic field.

25. The method of claim 21, wherein the first electrical part is configured to magnify a flux produced by the antenna circuit.

26. The method of claim 21, wherein the wire loop antenna is placed substantially along at least one portion of a surface of a housing.

27. The method of claim 26, wherein the portion of the surface of the housing comprises a perimeter of the housing.

28. The method of claim 26, wherein the housing comprises a metallic material, and wherein the wire loop antenna is separated from the metallic material.

29. The method of claim 28, wherein a gap is formed between the wire loop antenna and the metallic material such that the magnetic field can pass through the gap.

30. The method of claim 26, wherein the wire loop antenna is separable from the housing, wherein the method further comprises allowing movement of the wire loop antenna relative to the housing.

31. A method, comprising:

determining whether there are greater dielectric losses than eddy current losses in an environment for receiving power via a magnetic field;

receiving power using a first resonator if the dielectric losses are greater than the eddy current losses in the environment; and receiving power using a second resonator if the eddy current losses are greater than the dielectric losses in the environment.

32. The method of claim 31, wherein the first resonator comprises an inductive loop with at least 3 turns.

33. The method of claim 31, wherein the second resonator comprises an inductive loop with two or fewer turns.

34. The method of claim 31, wherein the first resonator has a Q factor greater than 1500.

35. The method of claim 31, wherein a first inductance to capacitance ratio of the second resonator is greater than a second inductance to capacitance ratio of the first resonator.

36. A system for receiving wireless power, comprising:

a housing configured to house mobile electronics; and an antenna circuit configured to receive power via a magnetic field to power or charge a load, wherein the antenna circuit comprises a loop antenna portion placed along at least a portion of a surface of the housing.

37. The system of claim 36, wherein the portion of the surface of the housing comprises a perimeter of the housing.

38. The system of claim 36, wherein the housing comprises a nonmetallic material, and wherein the loop antenna portion is physically in contact with the nonmetallic material.

39. The system of claim 36, wherein the housing comprises a metallic material, and wherein the loop antenna portion is separated from the metallic material.

40. The system of claim 39, wherein a gap is formed due to the loop antenna portion being separated from the metallic material, wherein the gap is of a size through which magnetic field can pass through.

41. The system of claim 36, wherein the loop antenna portion is separable from the housing and movable relative to the housing.

42. The system of claim 36, further comprising a ferrite portion coupled to the housing and configured to hold at least a part of the loop antenna portion.

43. A system for receiving wireless power, comprising:

a housing;

a coil winding form extending across the housing from at least a first side of the housing to a second side of the housing;

a coil wound around the coil winding form; and at least one opening in the housing configured to allow magnetic fields to interact with the coil winding form.

44. The system of claim 43, wherein the coil winding form comprises a ferrite material.

45. The system of claim 43, further comprising a slot in the housing.

46. The system of claim 43, wherein the housing comprises a conductive material.

47. The system of claim 43, wherein the coil winding form is a cylindrical shaped form.

48. An RFID system, comprising:

a first layer comprising a first material that converts mechanical strain to electrical energy;

a second layer in mechanical contact with the first layer, wherein the second layer comprises a second material that changes position in response to an applied magnetic field; and a first output terminal, connected to receive the electrical energy from the second layer.

49. The RFID system of claim 48, wherein the second material comprises an electrically conductive magnetostrictive material.

50. The RFID system of claim 48, wherein the first material comprises a piezoelectric material.

51. The RFID system of claim 48, wherein the output terminal is connected directly to the second layer.

52. The RFID system of claim 51, further comprising a third layer comprising the second material, wherein the first layer is sandwiched between the second layer and the third layer, wherein the second layer and the third layer are electrically conductive, wherein the system further comprises a second output terminal, and wherein the first and second output terminals are connected to receive electrical energy from the second and third layers.

53. The RFID system of claim 48, wherein the first layer is arranged such that the first layer is compressed when the second layer changes position in response to the applied magnetic field.

54. A system for magnetic transmission of power, comprising:

an antenna circuit comprising a wire loop antenna, the wire loop antenna comprising a wire formed into at least one loop, the antenna circuit having an inductance L and a capacitance C, with an L/C value tuned for transmitting a magnetic field of a first frequency; and a first electrical part configured to increase an equivalent radius of the wire loop antenna without increasing a physical radius of the wire loop antenna.

55. The system of claim 54, wherein the at least one loop comprises a rectangular loop.

56. The system of claim 55, wherein the rectangular loop has rounded edges.

57. The system of claim 54, wherein the first electrical part increases the magnetic field such that the wire loop antenna operates as if the equivalent radius of the wire loop antenna is greater than the physical radius of the wire loop antenna.

58. The system of claim 54, wherein at least a portion of the first electrical part comprises a ferrite material.

59. The system of claim 54, wherein at least a portion of the first electrical part comprises a material that adds magnetic flux.

60. The system of claim 54, wherein the first electrical part comprises a flux magnification part.

61. The system of claim 60, wherein the flux magnification part has a relative permeability, wherein an amount of flux magnification is increased by a square root of the relative permeability.

62. The system of claim 60, wherein the flux magnification part includes a rod, and wherein an amount of flux magnification is related to a length of the rod.

63. The system of claim 54, further comprising a connection to an AC power source.

64. A system for receiving magnetic transmission of power, comprising:

means for wirelessly receiving power having an inductance L and a capacitance C with an L/C value tuned for receiving the power from a magnetic field of a first frequency, the means for wirelessly receiving power comprising means for producing an output that includes electrical power based on receiving the power from the magnetic field; and means for increasing an equivalent radius of the means for wirelessly receiving power without increasing a physical radius of the means for wirelessly receiving power.

65. The system of claim 64, wherein at least a portion of the means for increasing an equivalent radius comprises a ferrite material.

66. The system of claim 64, wherein at least a portion of the means for increasing an equivalent radius comprises a material that increases magnetic flux in the system.

67. The system of claim 64, wherein the means for wirelessly receiving power comprises an antenna circuit comprising a wire loop antenna.

68. A system for receiving wireless power, comprising:

a housing configured to house mobile electronics; and means for receiving power via a magnetic field at a level sufficient to power or charge a load, wherein the means for receiving power is placed along at least a portion of a surface of the housing.

69. The system of claim 68, wherein the portion of the surface of the housing comprises a perimeter of the housing.

70. The system of claim 68, wherein the means for receiving power is seperable from the housing and movable relative to the housing.

* * * * *